US008760384B2

(12) United States Patent
Nonaka et al.

(10) Patent No.: US 8,760,384 B2
(45) Date of Patent: Jun. 24, 2014

(54) IMAGE DISPLAY APPARATUS AND IMAGE DISPLAY METHOD

(75) Inventors: Ryosuke Nonaka, Kawasaki (JP); Masahiro Baba, Yokohama (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 922 days.

(21) Appl. No.: 12/812,667

(22) PCT Filed: Feb. 27, 2009

(86) PCT No.: PCT/JP2009/054224

§ 371 (c)(1),
(2), (4) Date: Jul. 13, 2010

(87) PCT Pub. No.: WO2009/119278

PCT Pub. Date: Oct. 1, 2009

(65) Prior Publication Data

US 2011/0012824 A1 Jan. 20, 2011

(30) Foreign Application Priority Data

Mar. 28, 2008 (JP) ..... 2008-87381

(51) Int. Cl.
*G09G 3/36* (2006.01)

(52) U.S. Cl.
USPC ..... 345/102

(58) Field of Classification Search
CPC ... G09G 3/3406; G09G 3/3413; G09G 3/342; G09G 3/3426
USPC ..... 345/102
See application file for complete search history.

(56) References Cited

U.S. PATENT DOCUMENTS 6,891,672 B2 5/2005 Whitehead et al.
2005/0104838 A1 5/2005 Sasaki (Continued)

FOREIGN PATENT DOCUMENTS

EP 1 482 475 12/2004
JP 01-239589 9/1989

(Continued)

OTHER PUBLICATIONS

International Search Report for PCT/JP2009/054224 mailed on Jun. 2, 2009.

(Continued)

*Primary Examiner* — Latanya Bibbins
(74) *Attorney, Agent, or Firm* — Amin, Turocy & Watson, LLP

(57) ABSTRACT

An image display apparatus includes: a backlight configured to emit light; a liquid crystal panel configured to modulate light emitted from the backlight to make an image display; a backlight luminance calculating unit configured to calculate a light-emission luminance of the backlight such that a center value of a luminance range displayable on the liquid crystal panel defined depending on the light-emission luminance of the backlight substantially agrees with a center value of luminances of pixels forming an input image; a backlight controlling unit configured to control light emission of the backlight so that the light from the backlight is emitted with the calculated light-emission luminance; a luminance correcting unit configured to correct the luminance of each pixel in the input image in accordance with the calculated light-emission luminance; and a liquid crystal controlling unit configured to control modulation of the liquid crystal panel based upon the corrected input image.

8 Claims, 23 Drawing Sheets

(56) References Cited

U.S. PATENT DOCUMENTS

| | | | | |
|---|---|---|---|---|
| 2005/0104840 | A1 | 5/2005 | Sohn et al. | |
| 2008/0002062 | A1 * | 1/2008 | Kim et al. | 348/602 |
| 2008/0074372 | A1 | 3/2008 | Baba et al. | |
| 2009/0002285 | A1 | 1/2009 | Baba et al. | |
| 2009/0115907 | A1 | 5/2009 | Baba et al. | |
| 2009/0140975 | A1 | 6/2009 | Nonaka et al. | |
| 2009/0201245 | A1 | 8/2009 | Nonaka et al. | |

FOREIGN PATENT DOCUMENTS

| | | | |
|---|---|---|---|
| JP | 06-102484 | | 4/1994 |
| JP | 11-065531 | | 3/1999 |
| JP | 11-109317 | | 4/1999 |
| JP | 2001-027890 | | 1/2001 |
| JP | 2002-099250 | | 4/2002 |
| JP | 2002099250 | A * | 4/2002 |
| JP | 2005-309338 | | 11/2005 |
| WO | 03/075257 | A1 | 9/2003 |

OTHER PUBLICATIONS

Swinkels, et al. Effect of Backlight Segmentation on Perceived Image Quality for HDR Displays, IDW '06, VHF3-4, 2006, pp. 1451-1454.

Translation of Official Action of Notification of Reason for Rejection for Japanese Patent Application No. 2008-087381 Dated Apr. 19, 2013, 8 pgs.

* cited by examiner

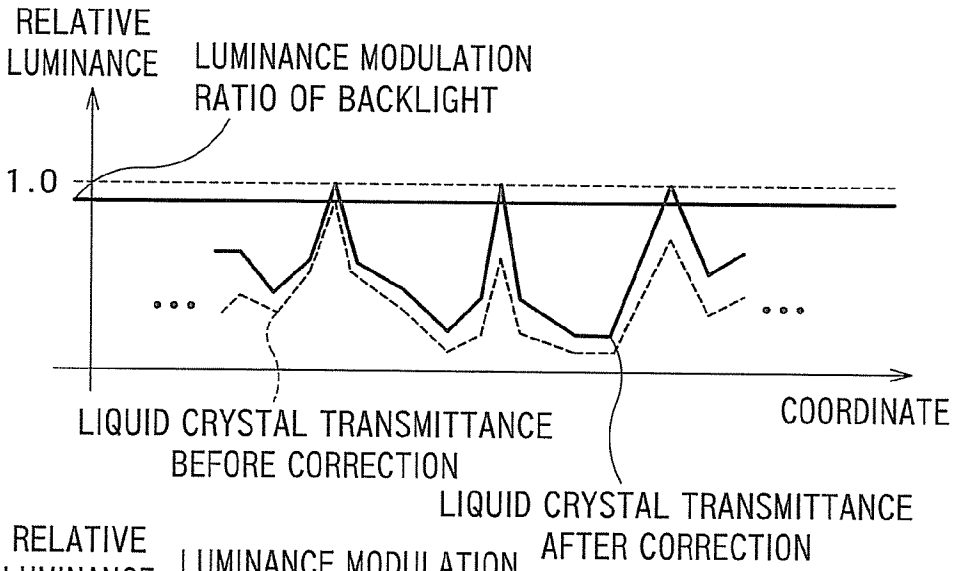
FIG. 8A
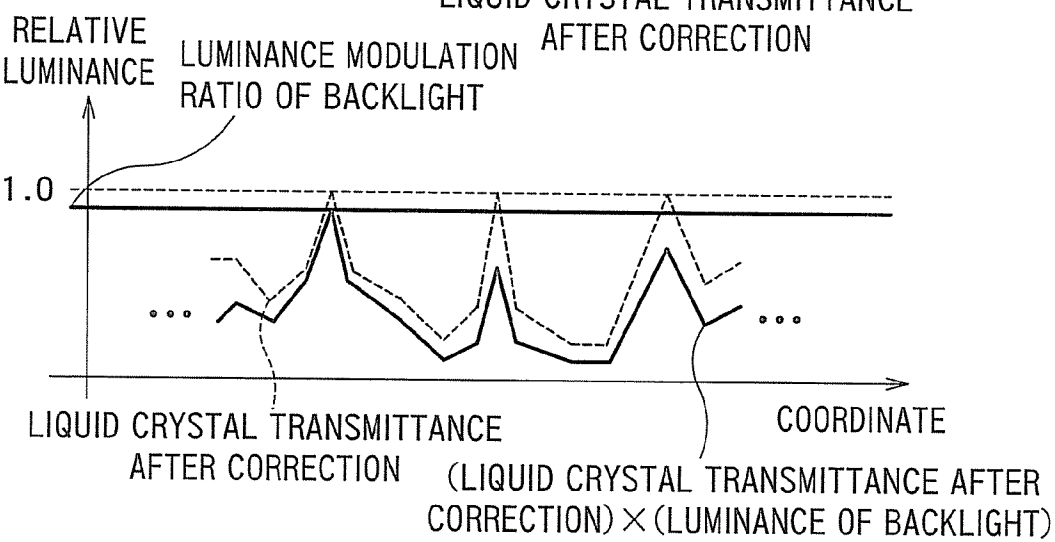
FIG. 8B
FIG. 8

IMAGE DISPLAY APPARATUS AND IMAGE DISPLAY METHOD

TECHNICAL FIELD

The present invention relates to an image display apparatus and an image display method.

BACKGROUND ART

Conventionally, in a liquid crystal display apparatus, a luminance of a backlight has been controlled for purposes of expanding a display dynamic range, lowering consumption power, and the like.

For example, in JP-A 2005-309338 (Kokai), a luminance of a backlight is controlled so that the maximum luminance in the input image can be displayed by calculating a modulation ratio of the luminance of the backlight from the maximum luminance value in an input image.

However, since spatial and temporal fluctuations in maximum value of the luminance of the image are drastic, fluctuations in luminance of the backlight calculated based upon the maximum value are also drastic, leading to flickering of the display.

DISCLOSURE OF THE INVENTION

According to an aspect of the present invention, there is provided with an image display apparatus, comprising: a backlight configured to emit light; a liquid crystal panel configured to modulate light emitted from said backlight to make an image display; a backlight luminance calculating unit configured to calculate a light-emission luminance of said backlight such that a center value of a luminance range displayable on said liquid crystal panel defined depending on the light-emission luminance of said backlight substantially agrees with a center value of luminances of each pixel forming an input image; a backlight controlling unit configured to control light emission of said backlight so that the light is emitted with the calculated light-emission luminance; a luminance correcting unit configured to correct the luminances of each pixel in the input, image in accordance with said calculated light-emission luminance; and a liquid crystal controlling unit configured to control modulation of said liquid crystal panel based upon the corrected input image.

According to an aspect of the present invention, there is provided with an image display method performed using a backlight configured to emit light and a liquid crystal panel configured to modulate light emitted from said backlight to make an image display, comprising: calculating a light-emission luminance of said backlight such that a center value of a luminance range displayable on said liquid crystal panel defined depending on the light-emission luminance of said backlight substantially agrees with a center value of luminance of each pixel forming an input image; controlling light emission of said backlight so that the light is emitted with the calculated light-emission luminance; correcting the luminance of each pixel in the input image in accordance with said calculated light-emission luminance; and controlling modulation of said liquid crystal panel based upon the corrected input image.

BRIEF DESCRIPTION OF THE DRAWINGS

FIGS. 8A and 8B are views explaining an effect due to an operation of the liquid crystal transmittance corrector according to the first embodiment;

BEST MODE FOR CARRYING OUT THE INVENTION

First Embodiment

An image display apparatus according to a first embodiment of the present invention is described with reference to drawings.

Configuration of Image Display Apparatus

Figure 1:
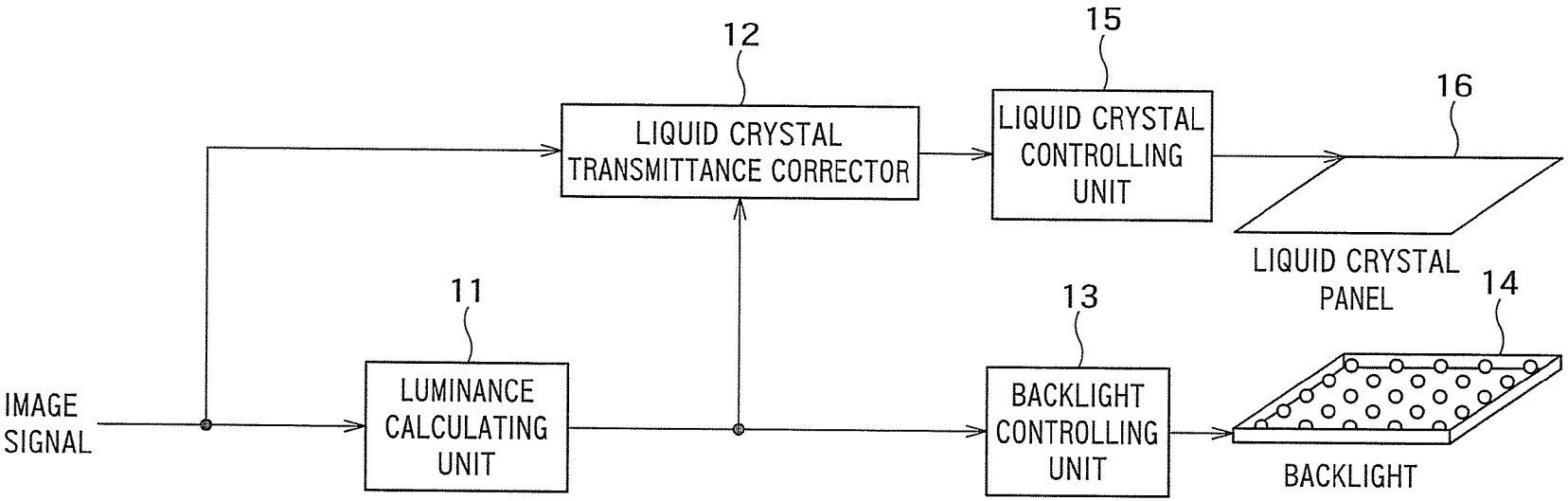
FIG. 1 is a view showing a constitution example of an image display apparatus according to a first embodiment.

FIG. 1 shows a configuration of the image display apparatus according to the present embodiment. An image display apparatus according to the present embodiment includes a luminance calculating unit 11, a liquid crystal transmittance corrector 12, a backlight controlling unit 13, a backlight 14, a liquid crystal controlling unit 15, and a liquid crystal panel 16 where a plurality of pixels are arrayed in matrix form.

The luminance calculating unit 11 calculates a luminance modulation ratio of the backlight 14 which is suitable for display based upon an image signal of one frame. The liquid crystal transmittance corrector 12 corrects a luminance (light transmittance) of each pixel in the image signal based upon the calculated luminance modulation ratio (light-emission luminance) of the backlight 14, and outputs the corrected image signal to the liquid crystal controlling unit 15. The backlight controlling unit 13 makes the backlight 14 lighted (emit light) based upon the luminance modulation ratio calculated by the luminance calculating unit 11. The backlight 14 emits light by control of the backlight controlling unit 13. The liquid crystal controlling unit 15 controls the liquid crystal panel 16 based upon the image signal corrected by the liquid crystal transmittance corrector 12. The liquid crystal panel 16 changes an amount of transmittance light from the backlight 14 by control of the liquid crystal controlling unit 15. Namely, the liquid crystal panel 16 modulates the light emission of the backlight 14 to display an image corresponding to the image signal of the one frame.

In the following, the configuration and operation of each unit are described in detail.

Backlight 14

Figure 2:
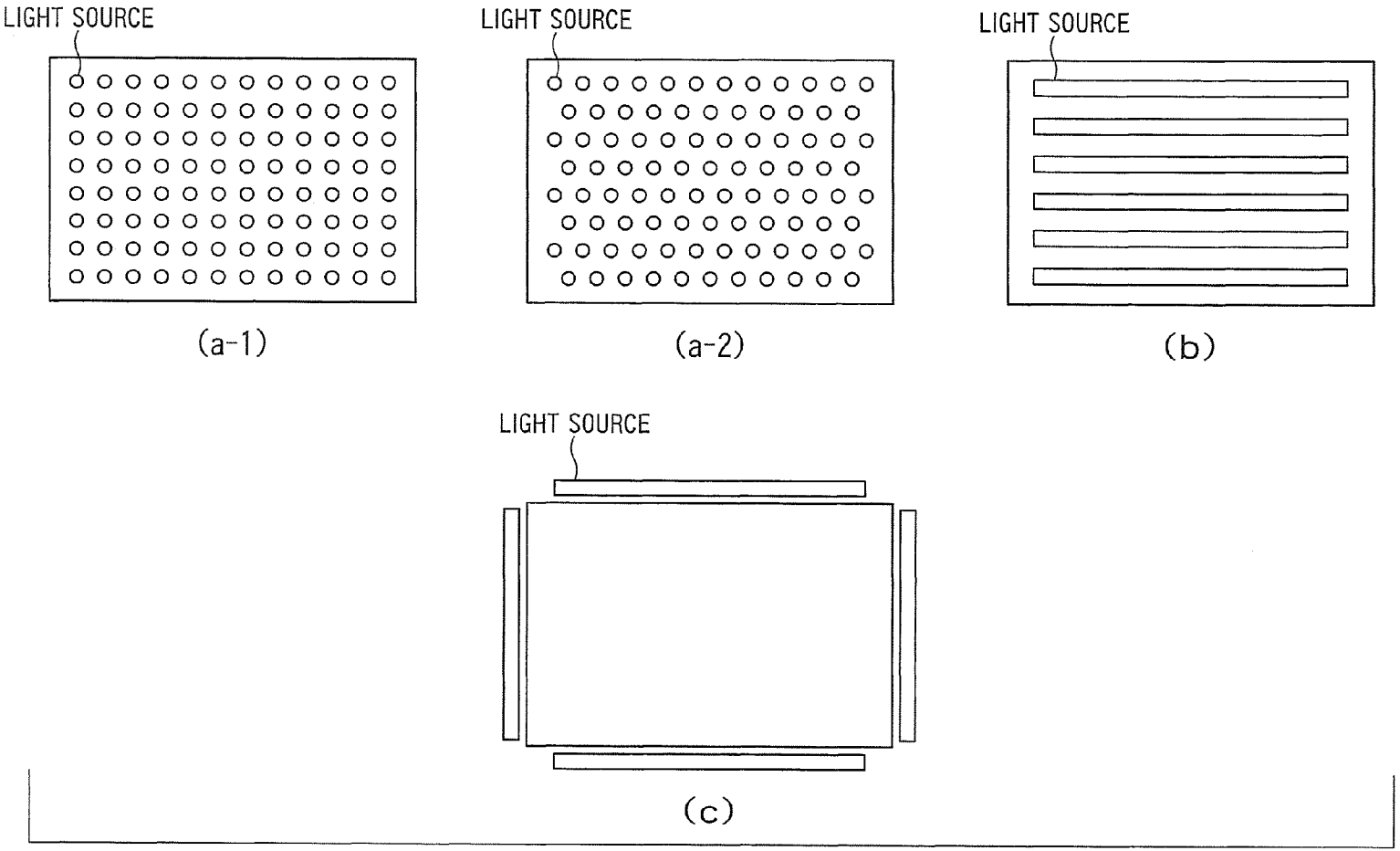
FIG. 2 is a view showing a constitution example of a backlight according to the first embodiment.

The backlight 14 is lighted strongly or weakly by control of the backlight controlling unit 13, and irradiates the liquid crystal panel 16 from the back surface thereof. FIGS. 2(*a*-1), (*a*-2), (*b*), and (*c*) show a configuration of one specific example of the backlight 14. As shown in FIGS. 2(*a*-1), (*a*-2) and (*b*), and (*c*), the backlight 14 has at least not less than one light sources. The arrangement of the light sources may be a direct type as shown in FIGS. 2(*a*-1), (*a*-2) and (*b*), where the light sources are arranged on the back surface of the liquid crystal panel 16, or may be an edge light type as shown in FIG. 2(*c*), where the light sources are arranged on the side surfaces of the liquid crystal panel 16 and light is led to the back surface of the liquid crystal panel 16 by a light guiding board or a reflector, not shown, to irradiate the liquid crystal panel 16 from the back surface thereof. An LED, a cold-cathode tube, a hot-cathode tube, and the like are suitable for the light source. The LED is particularly preferably used as the light-emitting element since it has a large width between the maximum light emittable luminance and the minimum light emittable luminance and hence its light emission can be controlled in a high dynamic range. The light-emission intensity (light-emission luminance) and the light-emission timing of the backlight 14 are controllable by the backlight controlling unit 13.

Backlight Controlling Unit 13

Figure 3A:
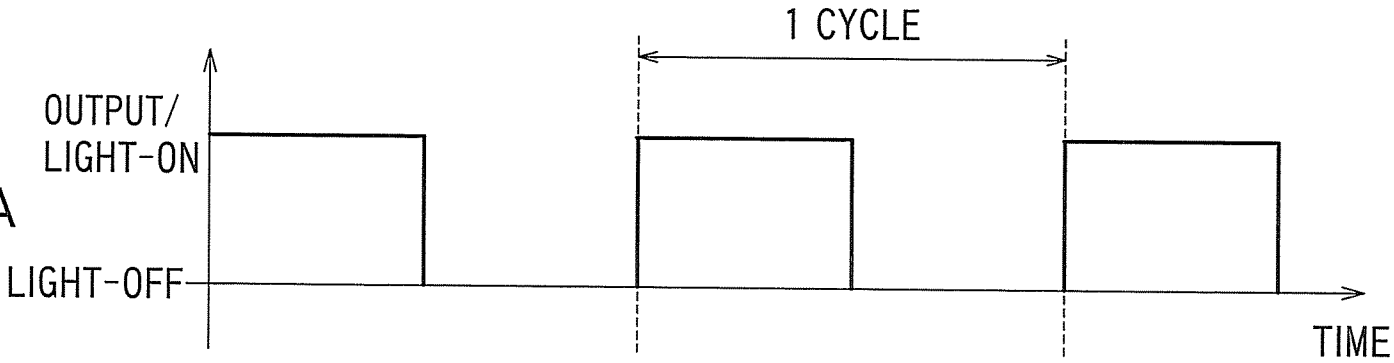
FIGS. 3A and 3B are views explaining a lighting system of the backlight.
Figure 3B:
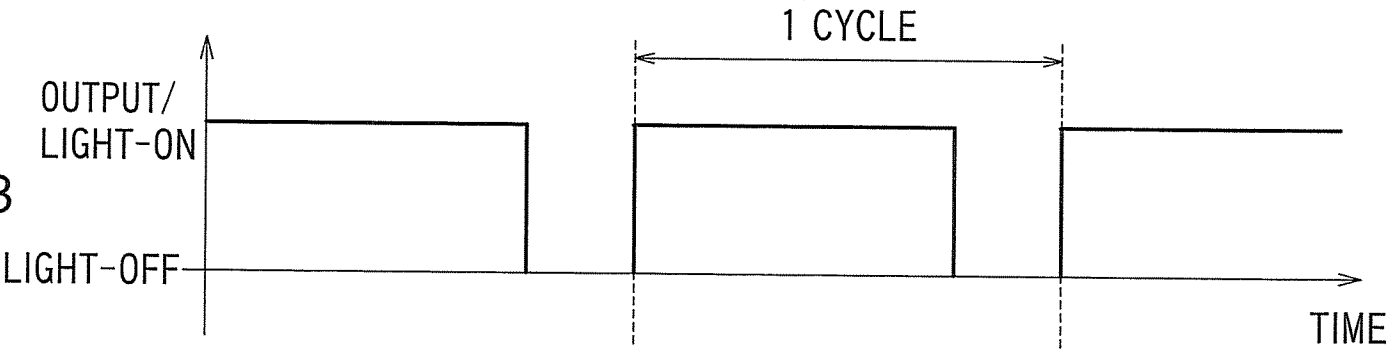

The backlight controlling unit 13 makes the backlight 14 lighted based upon the luminance modulation ratio of the backlight 14 which was calculated by the luminance calculating unit 11. The luminance modulation ratio is a value showing a ratio of the light-emission luminance with which the backlight 14 is to be lighted with respect to the light-emission luminance of the backlight 14 with which the backlight 14 is most brightly lighted. FIGS. 3A and 3B show examples of output of the backlight controlling unit 13 in the case of controlling the backlight 14 by use of a PWM (Pulse Width Modulation) system. FIGS. 3A and 3B show the respective output examples in the case of outputting a PWM control signal in correspondence with a luminance modulation ratio of 0.5 and a luminance modulation ratio of 0.75 with respect to the light-emission luminance during constant lightening of the backlight. In the PWM system, the luminance of the backlight 14 is controlled by changing a rate of a lightening period during one cycle. As thus described, the backlight controlling unit 13 is capable of controlling the light-emission intensity (light-emission luminance) and the light-emission timing of the backlight 14.

Luminance Calculating Unit 11

Figure 4A:
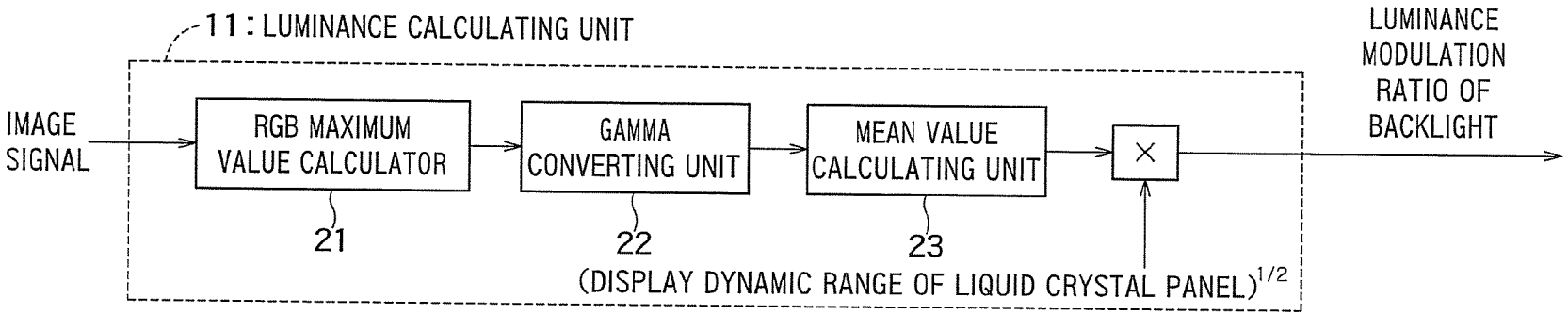
FIGS. 4A and 4B are views showing a constitution example of a luminance calculating unit according to the first embodiment.

The luminance calculating unit 11 calculates from an image signal a luminance modulation ratio of the backlight 14 which is suitable for display. FIG. 4A shows a configuration of one specific example of this luminance calculating unit 11. The luminance calculating unit 11 in FIG. 4A includes an RGB maximum value calculator 21, a gamma converting unit 22 and a mean value calculating unit 23.

The RGB maximum value calculator 21 obtains the maximum value out of image signals corresponding to R(red), G(green) and B(blue) in each pixel, and outputs the obtained value. Hereinafter, a signal calculated in the RGB maximum value calculator 21 is referred to as an RGB maximum signal.

The gamma converting unit 22 converts the inputted RGB maximum signal into a relative luminance "$L_{MAX}$" by gamma conversion. When the input image signal is a signal in a range of [0, 255], this conversion is expressed for example by:

$$L_{MAX}=(1-\alpha)(S_{MAX}/255)^{\gamma}+\alpha \quad \text{[Formula 1]}$$

Here, "$S_{MAX}$" is an RGB maximum signal calculated in the RGB maximum value calculator 21. "γ" and "α" may be arbitral actual numbers, but in the case of performing this conversion in the most simplified manner, "α=0.0" and "γ=2.2" are typically used. These conversions may be directly calculated by use of a multiplier or the like, or may be calculated by use of a lookup table. Hereinafter, the relative luminance "$L_{MAX}$" calculated by the pair of the RGB maximum value calculator 21 and the gamma converting unit 22 is referred to as an RGB maximum luminance.

Figure 4B:
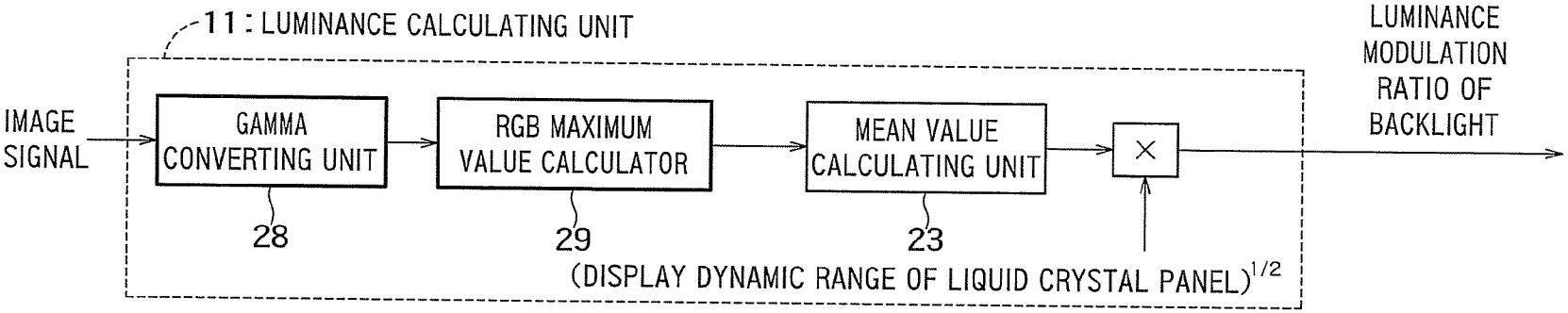

Computing by the RGB maximum value calculator 21 and computing by the gamma converting unit 22 may be performed in a reversed order, and FIG. 4B shows the configuration of the luminance calculating unit 11 in this case. The gamma converting unit 28 converts the inputted image signal into relative luminances "$L_R$", "$L_G$" and "$L_B$" of R(red), G(green) and B(blue) by gamma conversion. When the image signal is a signal in the range of [0, 255] corresponding to the respective colors of "R", "G" and "B", this conversion is expressed for example by:

$$\begin{cases} L_R = (1-\alpha)(S_R/255)^{\gamma}+\alpha, \\ L_G = (1-\alpha)(S_G/255)^{\gamma}+\alpha, \\ L_B = (1-\alpha)(S_B/255)^{\gamma}+\alpha, \end{cases} \quad \text{[Formula 2]}$$

Here, "$S_R$", "$S_G$" and "$S_B$" are image signal values corresponding to "R", "G" and "B". "γ" and "α" may be arbitral actual numbers, but in the case of performing this conversion in the most simplified manner, "α=0.0" and "γ=2.2" are typically used. These conversions may be directly calculated by use of the multiplier or the like, or may be calculated by use of the lookup table. Further, in this case, an RGB maximum value calculator 29 obtains the maximum value out of the respective relative luminances corresponding to "R", "G" and "B" in each pixel which were calculated in a gamma converting unit 28, and outputs the obtained value.

The mean value calculating unit 23 calculates a mean value of the RGB maximum luminance from the RGB maximum luminances of a plurality of pixels. In the mean value calculating unit 23, a spatial range as an object for calculating the mean value may be a range of the whole liquid crystal panel 16 or may be a range smaller than this.

Figure 5:
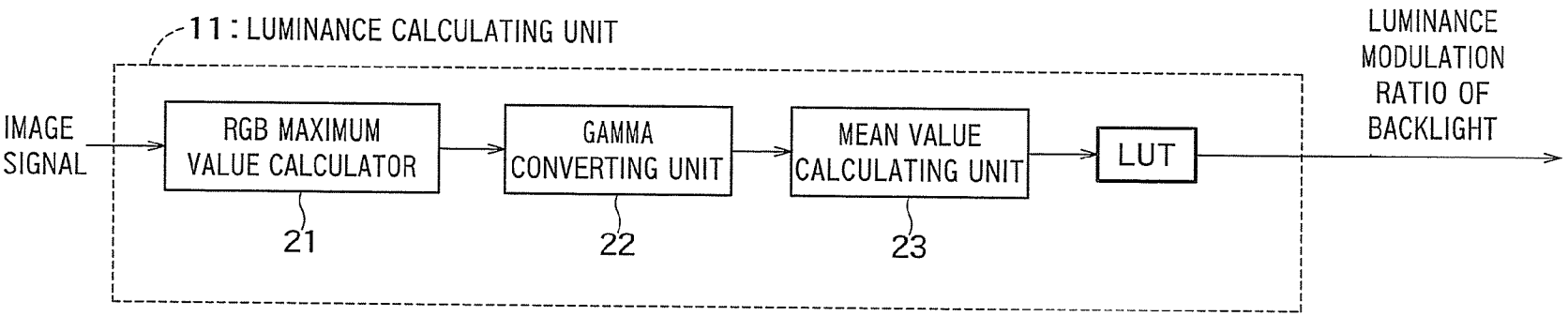
FIG. 5 is a view showing another constitution example of the luminance calculating unit according to the first embodiment.

The luminance calculating unit 11 outputs a value, obtained by multiplying the mean relative luminance which was calculated in the mean value calculating unit 23 by a square root of a display dynamic range of the liquid crystal panel 16, as a luminance modulation ratio of the backlight 14. This computing may be made by the multiplier or may be realized such that, as shown in FIG. 5, a lookup table for the relation between the mean relative luminance and the luminance modulation ratio of the backlight 14 is previously formed and this lookup is referenced. Here, the display dynamic range of the liquid crystal panel 16 is a value decided by a display contrast characteristic of a single substance of the liquid crystal panel 16, and a value obtained by: (maximum displayable luminance)/(the minimum displayable luminance) of the liquid crystal panel 16. For example, in a case where the liquid crystal panel 16 has the contrast characteristic of a contrast ratio of 1000:1 [(maximum displayable luminance):(minimum displayable luminance)], the display dynamic range of the liquid crystal panel 16 here is 1000.

When the mean relative luminance calculated in the mean value calculating unit 23 is represented by "$L_{MEAN}$" and the display dynamic range of the liquid crystal panel 16 is represented by "$D_P$", the output of the luminance calculating unit 11 (the luminance modulation ratio of the backlight 14) "$L_{set}$" is a value obtained by the mean relative luminance which was calculated in the mean value calculating unit 23 by the square root of the display dynamic range of the liquid crystal panel 16, namely: $L_{set}=L_{MEAN}\times D_P^{1/2}$ In a case where the backlight 14 is lighted exactly with this modulation ratio, the maximum relative luminance $L_U$ and the minimum relative luminance $L_L$, which are displayable in the present image display apparatus due to the modulation of the backlight luminance, is:

$$L_U=L_{set},$$

$$L_L=(1/D_p)\times L_{set},$$

Therefore, when considered in terms of a logarithmic value of the relative luminance, a center $\mathrm{Log}(L_C)$ of the range of the relative luminance displayable in the present image display apparatus is:

$$\log(L_C)=\frac{\log(L_U)+\log(L_L)}{2},\quad \text{namely}$$

$$\begin{aligned} L_C &= \exp\left(\frac{\log(L_U)+\log(L_L)}{2}\right),\\ &= \exp\left(\frac{\log(L_{set})+\log((1/D_P)\times L_{set})}{2}\right),\\ &= L_{set}/D_P^{1/2},\\ &= (L_{MEAN}\times D_P^{1/2})/D_P^{1/2},\\ &= L_{MEAN}, \end{aligned}$$

Therefore, when considered in terms of the logarithmic value of the relative luminance, a relative luminance at the center of the range of the relative luminance displayable in the present image display apparatus agrees with the mean relative luminance calculated in the mean value calculating unit 23. As thus described, the value obtained by multiplying the mean relative luminance which was calculated in the mean value calculating unit 23 by the square root of the display dynamic range of the liquid crystal panel 16 is used as the luminance modulation ratio of the backlight 14, whereby it is possible to make the mean relative luminance calculated in the mean value calculating unit 23 agree with the relative luminance at the center of the range of the relative luminance displayable in the present image display apparatus when considered in terms of the logarithmic value of the relative luminance.

It should be noted that even with the luminance modulation ratio of the backlight 14 calculated as thus described, if later-described correction of a transmittance ratio of the image signal (correction of the luminance) is not made in the liquid crystal transmittance corrector 12, the display image simply becomes dark due to the luminance modulation of the backlight 14.

Further, the luminance modulation ratio of the backlight 14, calculated in the luminance calculating unit 11, is not restricted to the value obtained by multiplying the mean relative luminance which was calculated in the mean value calculating unit 23 by the square root of the display dynamic range of the liquid crystal panel 16, but may be a value with which the center of the luminance range displayable due to modulation of the backlight luminance agrees with the mean value of the luminance of the input image inside the screen. Accordingly, the value by which the mean relative luminance is multiplied in the above multiplier may be a value close to the square root of the display dynamic range of the liquid crystal panel 16, or the relation between the mean relative luminance and the luminance modulation ratio of the backlight 14 in the lookup table may be a relation which is experientially and experimentally decided such that the center of the luminance range displayable due to the modulation of the backlight luminance agrees with the mean value of the luminance of the input image inside the screen.

Liquid Crystal Transmittance Corrector 12

Figure 6:
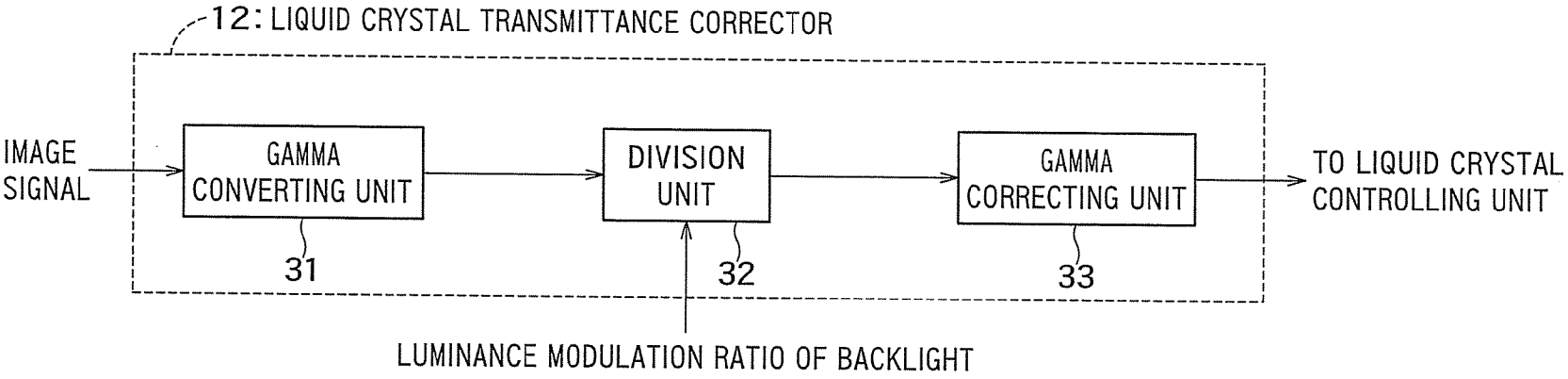
FIG. 6 is a view showing a constitution example of a liquid crystal transmittance corrector according to the first embodiment.
Figure 7:
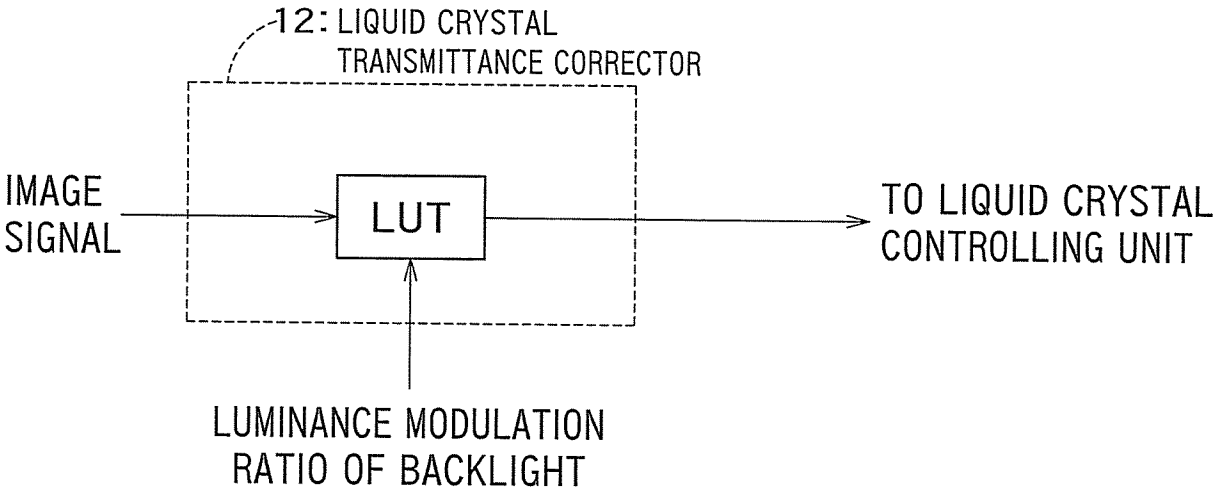
FIG. 7 is a view showing another constitution example of the liquid crystal transmittance corrector according to the first embodiment.

The liquid crystal transmittance corrector 12 corrects the luminance (transmittance) of the image signal in each pixel in the liquid crystal panel 16 based upon the inputted image signal and the luminance modulation ratio of the backlight 14 which was calculated in the luminance calculating unit 11, and outputs the corrected image signal to the liquid crystal controlling unit 15. FIG. 6 shows one specific example of this liquid crystal transmittance corrector 12.

This liquid crystal transmittance corrector 12 includes a gamma converting unit 31, a division unit 32 and a gamma correcting unit 33. The gamma converting unit 31 has the same configuration as that of the gamma converting unit 22 in the luminance calculating unit 11. It is to be noted that a value calculated by the gamma converting unit 31 in the liquid crystal transmittance corrector 12 may particularly be called a light transmittance instead of the relative luminance in the luminance calculating unit 11. The gamma converting unit 31 in the liquid crystal transmittance corrector 12 and the gamma converting unit 22 in the luminance calculating unit 11 can be configured as one constituent.

The gamma converting unit 31 converts the inputted image signal into light transmittances of "R", "G" and "B". Namely, the gamma converting unit performs conversion expressed by Formula (3):

$$\begin{cases} T_R=(1-\alpha)(S_R/255)^{\gamma}+\alpha,\\ T_G=(1-\alpha)(S_G/255)^{\gamma}+\alpha,\\ T_B=(1-\alpha)(S_B/255)^{\gamma}+\alpha, \end{cases} \qquad \text{[Formula 3]}$$

Here, "$S_R$", "$S_G$" and "$S_B$" are image signal values corresponding to "R", "G" and "B", and "$T_R$", "$T_G$" and "$T_B$" are light transmittances respectively corresponding to the colors of "R", "G" and "B". Values of "γ" and "α" of the gamma converting unit 31 may be identical values to or different values from the values of "γ" and "a" of the gamma converting unit 22 in the luminance calculating unit 11.

The division unit 32 corrects the light transmittances of "R", "G" and "B" of each pixel, which were calculated by the gamma converting unit 31, based upon the luminance modulation ratio of the backlight 14 which was calculated in the luminance calculating unit 11, and calculates the corrected light transmittance. Computing by the division unit 32 may be computing by a divider configured so as to divide the light transmittances of "R", "G" and "B" of each pixel, which were calculated by the gamma converting unit 31, by the luminance modulation ratio of the backlight 14 which was calculated in the luminance calculating unit 11, or may be computing performed by previously holding a lookup table that holds the relation between input and output previously and calculating a corrected light transmittance with reference to this lookup table.

The gamma correcting unit 33 makes a gamma correction to the corrected light transmittance calculated in the division unit 32, and converts the corrected light transmittance into an image signal to be outputted to the liquid crystal controlling unit 15. Assuming that the image signal to be outputted is a signal in the range of [0, 255] which corresponds to "R", "G" and "B", this gamma correction is made for example by using Formula (4) below:

$$\begin{cases} S'_R = 255 \times \{(T'_R - \alpha)/(1-\alpha)\}^{1/\gamma}, \\ S'_G = 255 \times \{(T'_G - \alpha)/(1-\alpha)\}^{1/\gamma}, \\ S'_B = 255 \times \{(T'_B - \alpha)/(1-\alpha)\}^{1/\gamma}, \end{cases} \quad \text{[Formula 4]}$$

Here, $T'_R$, $T'_G$ and $T'_B$ are respectively corrected light transmittances corresponding to the colors of "R", "G" and "B", and "$S'_R$", "$S'_G$" and "$S'_B$" are respectively output image signal values corresponding to "R", "G" and "B". "γ" and "α" may be arbitral actual numbers, but when "γ" is a gamma value of the liquid crystal panel 16 and α is a minimum light transmittance of the liquid crystal panel 16, it is possible to reproduce an image faithful to an input signal. Further, the gamma correction is not restricted to this conversion, but may be substituted by a known conversion system according to need, or may be reversed conversion in accordance with a gamma conversion table of the liquid crystal panel 16. These conversions may be directly calculated by use of the multiplier or the like, or may be calculated by use of the lookup table.

Modified Example of Liquid Crystal Transmittance Corrector 12

Since the operation of the liquid crystal transmittance corrector 12 is decided in accordance with the inputted luminance modulation ratio of the backlight 14 and image signal, the liquid crystal transmittance corrector 12 may be configured to calculate an image signal whose transmittance is corrected with reference to a previously set lookup table based upon the luminance modulation ratio, which was calculated in the luminance calculating unit 11 and the image signal.

Effect Relevant to Liquid Crystal Transmittance Corrector 12

The effect due to the operation of the liquid crystal transmittance corrector 12 executed as above are described with reference to FIGS. 8A and 8B. The light transmittance before the correction is assumed to be in the case of the relative luminance of the backlight 14 being the maximum, namely 1.0. Therefore, in the case of changing the luminance of the backlight 14 without correction of the light transmittance of the liquid crystal, an actual display becomes vastly different from a display having been assumed by the inputted image signal. Thereat, the light transmittance of the liquid crystal is corrected in the liquid crystal transmittance corrector 12 by use of the luminance modulation ratio of the backlight 14 which was calculated in the luminance calculating unit 11. In the liquid crystal transmittance corrector 12, the light transmittance before the correction is divided by the luminance modulation ratio of the backlight 14 which was calculated in the luminance calculating unit 11. Thereby, as shown in FIG. 8A, the corrected light transmittance is set large as compared with the light transmittance before the correction. Since an image presented to a viewer can be approximated by "(luminance of backlight)×(light transmittance of liquid crystal)", as shown in FIG. 8B, a relative luminance obtained by multiplying the corrected light transmittance by the luminance of the backlight 14 can be used for a display close to the display assumed by the inputted image signal.

Operations Relevant to Luminance Calculating Unit 11 and Liquid Crystal Transmittance Corrector 12

The effect of the present embodiment is described with reference to FIGS. 9 and 10, in connection with the operations of the luminance calculating unit 11 and the liquid crystal transmittance corrector 12 as described above.

Figure 9:
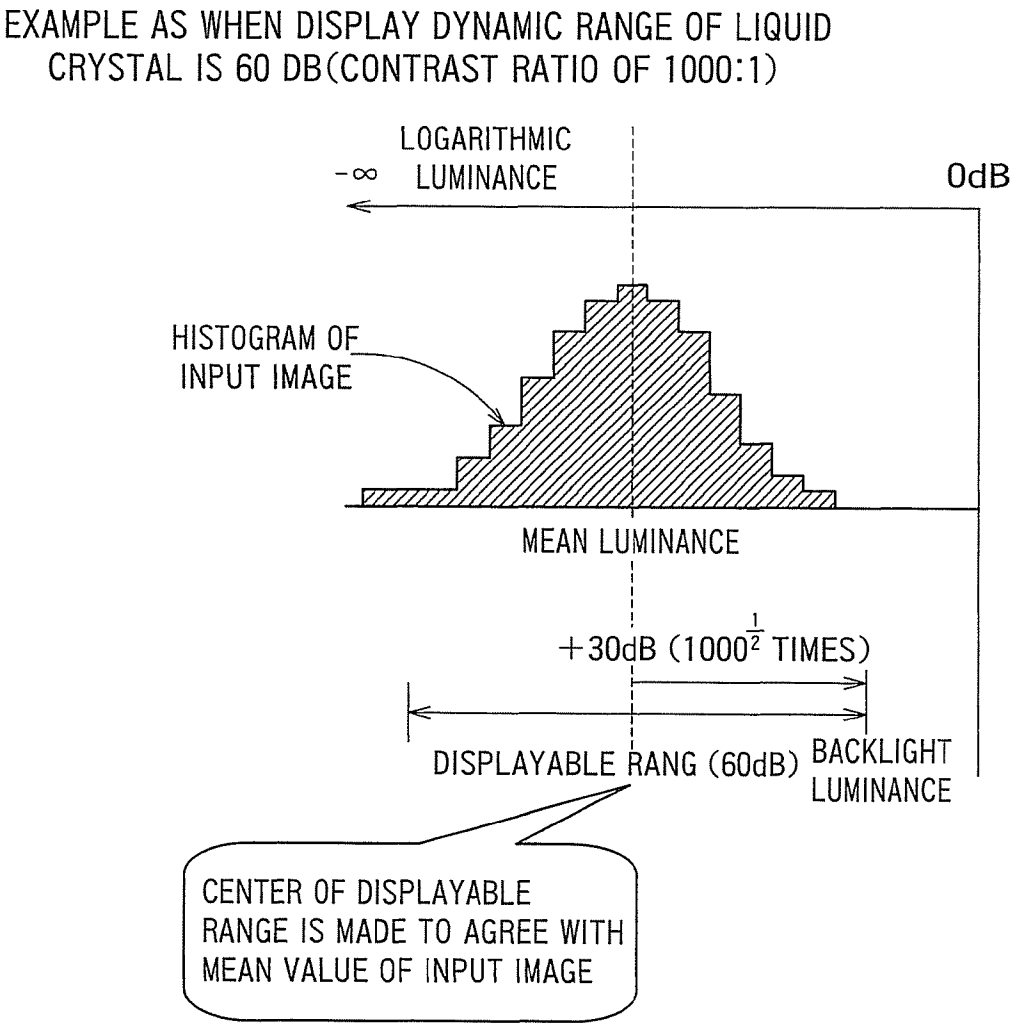
FIG. 9 is a view specifically explaining an effect according to the first embodiment.

FIG. 9 is a view for explaining the effect due to the present embodiment in the case of the display dynamic range of the liquid crystal panel 16 being 60 dB, namely the contrast ratio of the liquid crystal panel 16 being 1000:1. As shown in this example, in the case of the liquid crystal display device having the liquid crystal panel 16 with a display dynamic range of 60 dB, the range of the relative luminance displayable in this liquid crystal display device is a range of 60 dB from "the relative luminance of the backlight 14" to "a relative luminance of the backlight 14 minus 60 dB".

The relative luminance of the inputted image signal is widely distributed with its mean relative luminance at the center as in a histogram of the drawing. The luminance calculating unit 11 outputs, as the luminance modulation ratio of the backlight 14, a value obtained by multiplying the mean relative luminance which was calculated in the mean value calculating unit 23 by the square root of the display dynamic range of the liquid crystal panel 16. In the case of the display dynamic range of the liquid crystal panel 16 being 60 dB, the luminance modulation ratio of the backlight 14 is a value obtained by multiplying the mean relative luminance which was calculated in the mean value calculating unit 23 by a square root of 1000. Considering this in line with a logarithmic axis of the relative luminance, the luminance modulation ratio of the backlight 14 is a value obtained by adding ½ of 60 dB, namely 30 dB, to the mean relative luminance which was calculated in the mean value calculating unit 23. Assuming that the backlight 14 is lighted with the same relative luminance as the luminance modulation ratio of the backlight 14, the range of the luminance displayable in this liquid display device in the case of lighting the backlight 14 with this relative luminance is the range of ±30 dB with the mean relative luminance of the inputted image signal at the center, as shown in the drawing.

Figure 10:
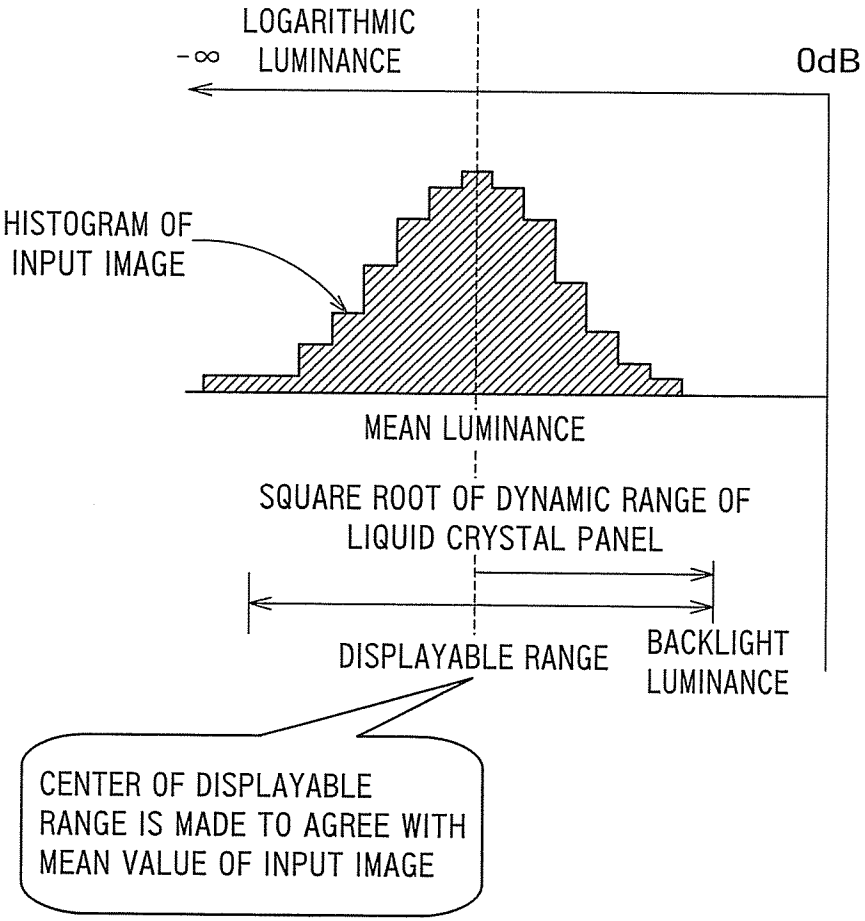
FIG. 10 is a view explaining, from a more general viewpoint, the effect according to the first embodiment.

FIG. 10 is a view explaining, from a more general viewpoint, the effect obtained by the present embodiment.

Generally, since the range of the relative luminance modulable in the liquid crystal panel 16 is narrow as compared with the range of the relative luminance of the image signal, a case may occur where a display cannot be made correspondingly to the input image signal no matter how the luminance of the backlight 14 is modulated, depending upon the inputted image signal. For example, in a case where the relative luminance of the inputted image signal is widely distributed from 0 to 1, the whole of this image signal cannot be faithfully reproduced in the liquid crystal display device.

Further, in the case of an image signal with the most thereof being a dark portion and the part thereof being a bright portion, when the backlight 14 is lighted such that the luminance of the backlight 14 agrees with the maximum luminance of the image signal, the bright portion of the image signal which makes up only the part thereof can be reproduced faithfully to the image signal whereas the dark portion making up the most thereof cannot be reproduced.

As opposed to this, according to the image display apparatus according to the present embodiment, since the luminance of the backlight 14 is controlled such that the luminance making up most of the image signal is arranged at the center of the display dynamic range, the most of the input image signal can be faithfully reproduced.

Further, there has been a problem in that, when the luminance of the backlight 14 is decided based upon the maximum value of the luminance in the input image, since spatial and temporal fluctuations in maximum value of the luminance in the input image are drastic, fluctuations in luminance of the backlight 14 calculated based upon the fluctuations in maximum value are also drastic, leading to flickering of the display. This was already described in the section "Background Art". Moreover, the maximum value of the luminance in the input image is often the luminance of a minute region in the input image, and in this case, the fluctuations in luminance of the minute region in the input image affect the whole image through the backlight luminance, which undesirably promotes occurrence of flickering. Further, in this case, even when a correction is made on the luminance of the image signal for compensating the fluctuations in luminance of the backlight 14, fluctuations in luminance that cannot be compensated by the correction of the image signal, or fluctuations in luminance rather amplified, occur and hence the occurrence of flickering cannot be suppressed.

As opposed to this, the luminance of the backlight 14 is set based upon the mean value in the input image in the display apparatus according to the present embodiment. Since the mean value is a stable value with small spatial and temporal fluctuations as compares with the maximum value, the flickering as described above tends not to occur. Further, since the mean value is a value to which luminances of many regions in the image are reflected, even when fluctuations in luminance of the mean value lead to fluctuations in luminance of the backlight 14, and further to fluctuations in display luminance of the whole image, these fluctuations tend not to be visually recognized as flickering since being in synchronous with the fluctuations in luminance of the whole input image.

Further, the above characteristic described concerning the mean of luminances of an input image can apply to a statistic value (center value) representing the center of a luminance distribution of an input image, such as a Median Value of luminance of an input image or a mode value of luminance of an input image.

Therefore, the luminance calculating unit 11 of the present invention can also be configured in the following manner.

Modified Example of Luminance Calculating Unit 11

Figure 11A:
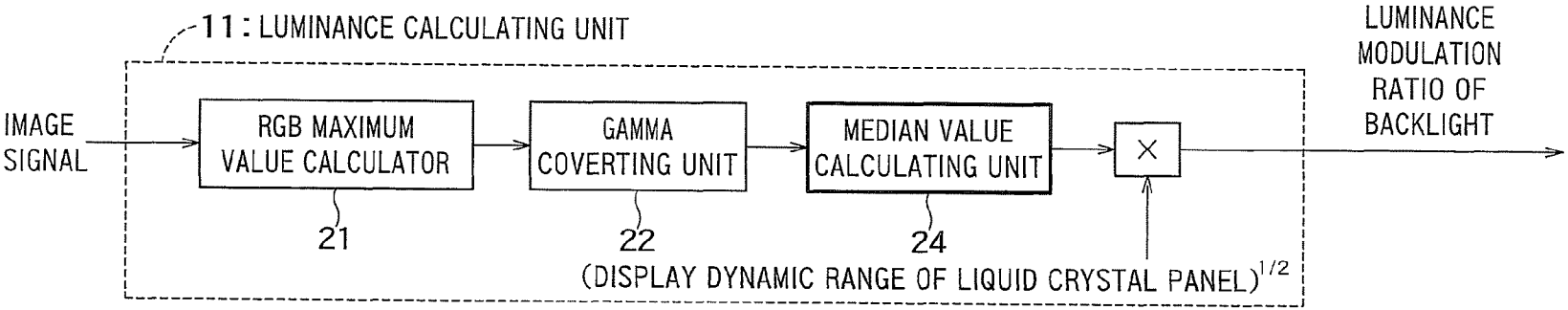
FIGS. 11A and 11B are views showing still another constitution example of the luminance calculating unit according to the first embodiment.

The luminance calculating unit 11 of the present embodiment may be configured to have a Median Value calculating unit 24 as shown in FIG. 11A.

The Median Value calculating unit 24 calculates a Median Value of the RGB maximum luminance from the RGB maximum luminances of a plurality of pixels. In the Median Value calculating unit 24, the spatial range as an object for calculating the Median Value may be the range of the whole liquid crystal panel 16 or may be a smaller region than this.

Modified Example 2 of Luminance Calculating Unit 11

Figure 11B:
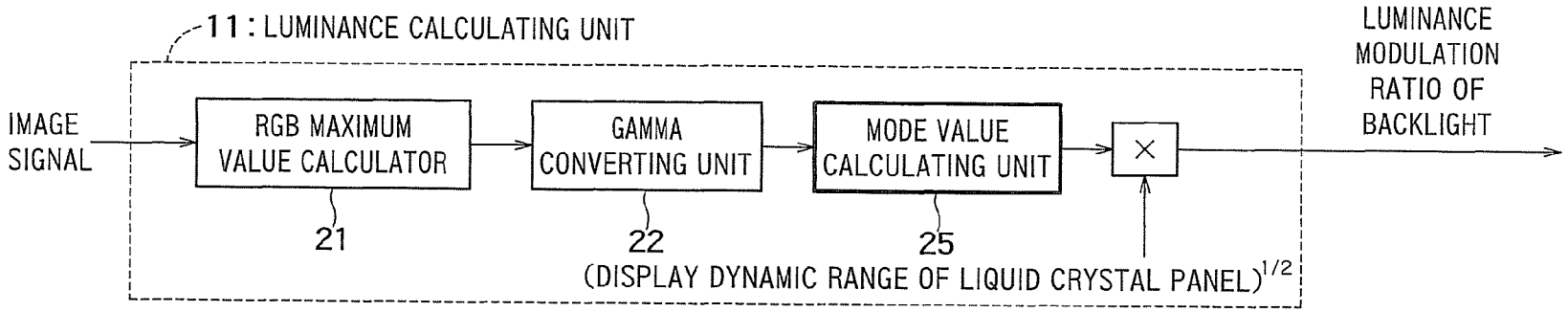

The luminance calculating unit 11 of the present embodiment may be configured to have a mode value calculating unit 25 as shown in FIG. 11B.

The mode value calculating unit 25 calculates a mode value of the RGB maximum luminance from the RGB maximum luminances of a plurality of pixels. In the mode value calculating unit 25, the spatial range as an object for calculating the mode value may be the range of the whole liquid crystal panel 16 or may be a smaller region than this.

Modified Example 3 of Luminance Calculating Unit 11

Figure 12A:
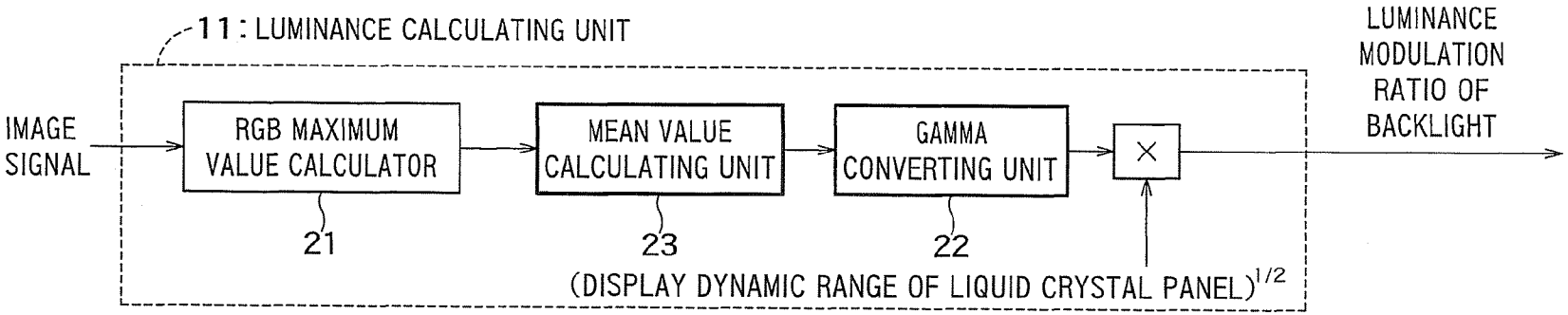
FIGS. 12A and 12B are views showing still another constitution example of the luminance calculating unit according to the first embodiment.

Further, a value as an object for calculating the mean value in the luminance calculating unit 11 is not necessarily a strict relative luminance value with respect to the image signal. For example, as shown in FIG. 12A, the luminance calculating unit 11 may be configured such that the mean value calculating unit 23 calculates a mean value of values corresponding to the input image signal, and after the calculation of the mean value, the gamma converting unit 22 converts the value into a value corresponding to the relative luminance. A slight difference in mean value appears between performing the gamma conversion before the calculation of the mean value and performing the gamma conversion after the calculation of the mean value, but the difference is not so large, and both values do not deviate from the configuration of the luminance calculating unit 11 in which the backlight luminance modulation ratio is calculated such that the center of the luminance range displayable by modulation of the backlight luminance agrees with the mean value of the luminance inside the screen of the input image.

Figure 12B:
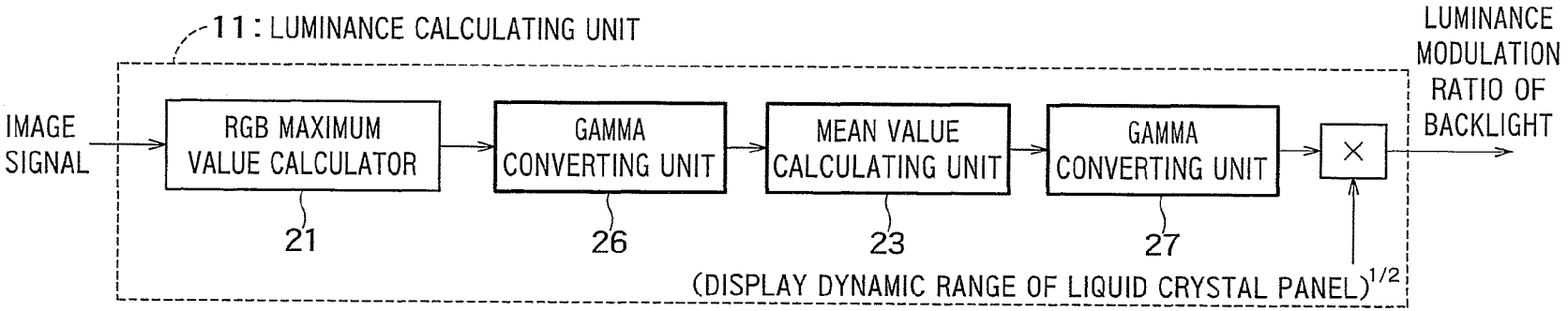

Moreover, as shown in FIG. 12B, the luminance calculating unit 11 may be configured such that the gamma conversion is performed by gamma converting units 26 and 27 before and after the calculation of the mean value in the mean value calculating unit 23 so that the convert into a value corresponding to the relative luminance is performed.

Liquid Crystal Panel 16 and Liquid Crystal Controlling Unit 15

Figure 13:
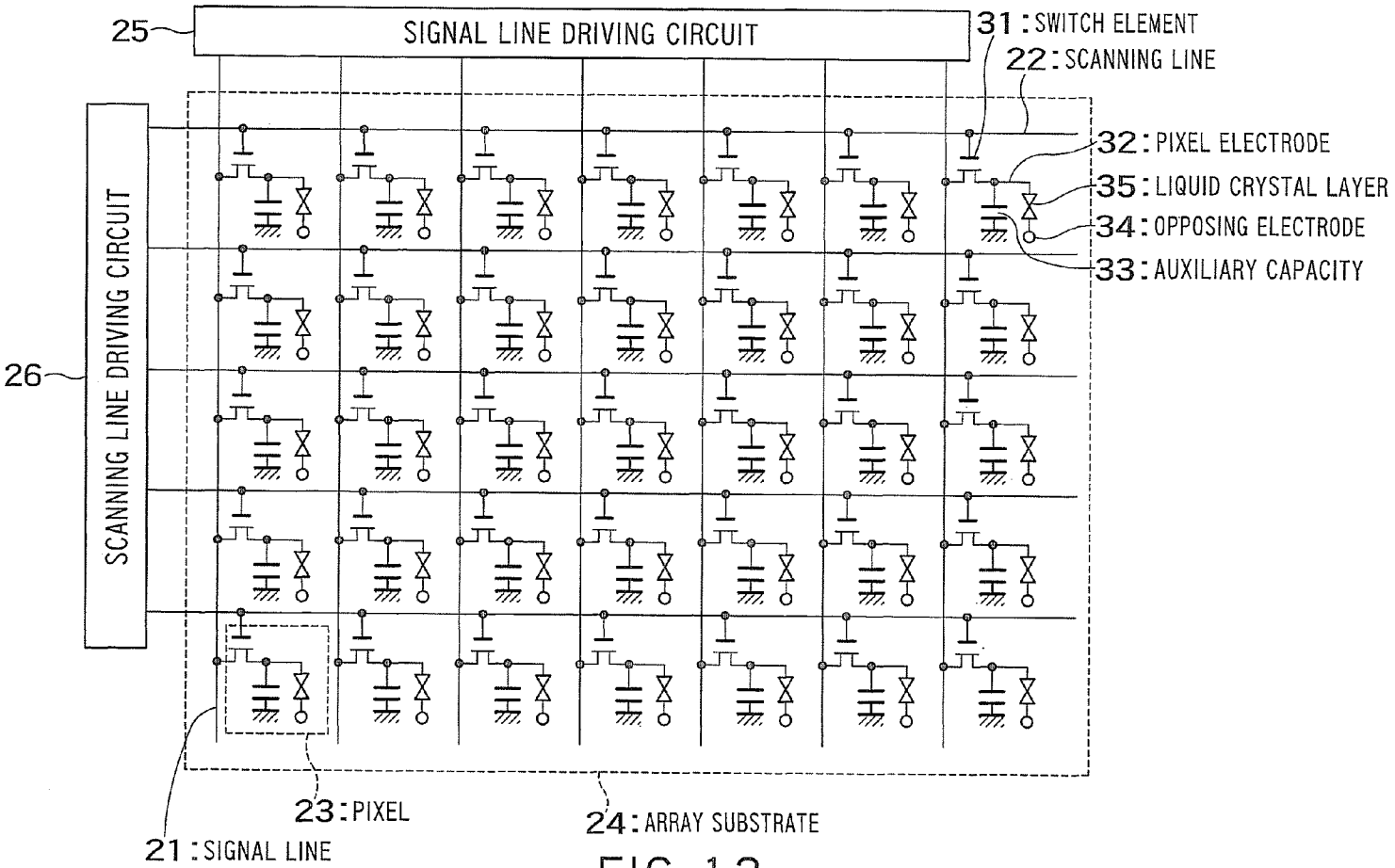
FIG. 13 is a view showing a constitution example of a liquid crystal panel.

The liquid crystal panel 16 is an active matrix type in the present embodiment, and as shown in FIG. 13, on an array substrate 24, a plurality of signal lines 21 and a plurality of scanning lines 22 intersecting with the signal lines are arranged through an insulating film, not shown, and a pixel 23 is formed in each intersecting region of the two lines. The ends of the signal lines 21 and the scanning lines 22 are respectively connected to a signal line driving circuit 25 and a scanning line driving circuit 26. Each pixel 23 includes a switch element 31 consisting of a thin-film transistor (TFT), a pixel electrode 32, a liquid crystal layer 35, an auxiliary capacity 33 and an opposing electrode 34. It is to be noted that the opposing electrode 34 is an electrode common to every pixel 23.

The switch element 31 is a switch element for writing an image signal, its gate is connected to the scanning line 22 in common on each one horizontal line, and its source is connected to the signal line 21 in common on each one vertical line. Further, its drain is connected to the pixel electrode 32 and also connected to the auxiliary capacity 33 electrically arranged in parallel with this pixel electrode 32.

The pixel electrode 32 is formed on the array substrate 24, and the opposing electrode 34 electrically opposed to this pixel electrode 32 is formed on an opposing substrate, not shown. A prescribed opposing voltage is given to the opposing electrode 34 from an opposing voltage generating circuit, not shown. Further, the liquid crystal layer 35 is held between the pixel electrode 32 and the opposing electrode 34, and the peripheries of the array substrate 24 and the above-mentioned opposing substrate are sealed by a sealing member, not shown. It is to be noted that a liquid crystal material used for the liquid crystal layer 35 may be any material, but for example, a ferroelectric liquid crystal, a liquid crystal in an OCB (Optically Compensated Bend) mode, or the like is suitable as the liquid crystal material.

The scanning line driving circuit 26 is configured of a shift resistor, a level shifter, a buffer circuit and the like, which are not shown. This scanning line driving circuit 26 outputs a row selection signal to each scanning line 22 based upon a vertical start signal and a vertical clock signal outputted as control signals from a display ratio controlling unit, not shown.

The signal line driving circuit 25 is configured of an analog switch, a shift resistor, a sample hold circuit, a video bus and the like, which are not shown. A vertical start signal and a vertical clock signal outputted as control signals from the display ratio controlling unit, not shown, are inputted into the signal line driving circuit 25, and also an image signal is inputted therein.

The liquid crystal controlling unit 15 controls the liquid crystal panel 16 so as to have a liquid crystal transmittance after the correction by the liquid crystal transmittance corrector 12.

Effect Relevant to Present Embodiment

According to the image display apparatus relevant to the present embodiment, it is possible to make an image display with a wide dynamic range and low consumption power with fluctuations in luminance alleviated due to the averaging effect and the flickering thus suppressed.

Second Embodiment

An image display apparatus according to a second embodiment of the present invention is described with reference to drawings.

Configuration of Image Display Apparatus

Figure 14:
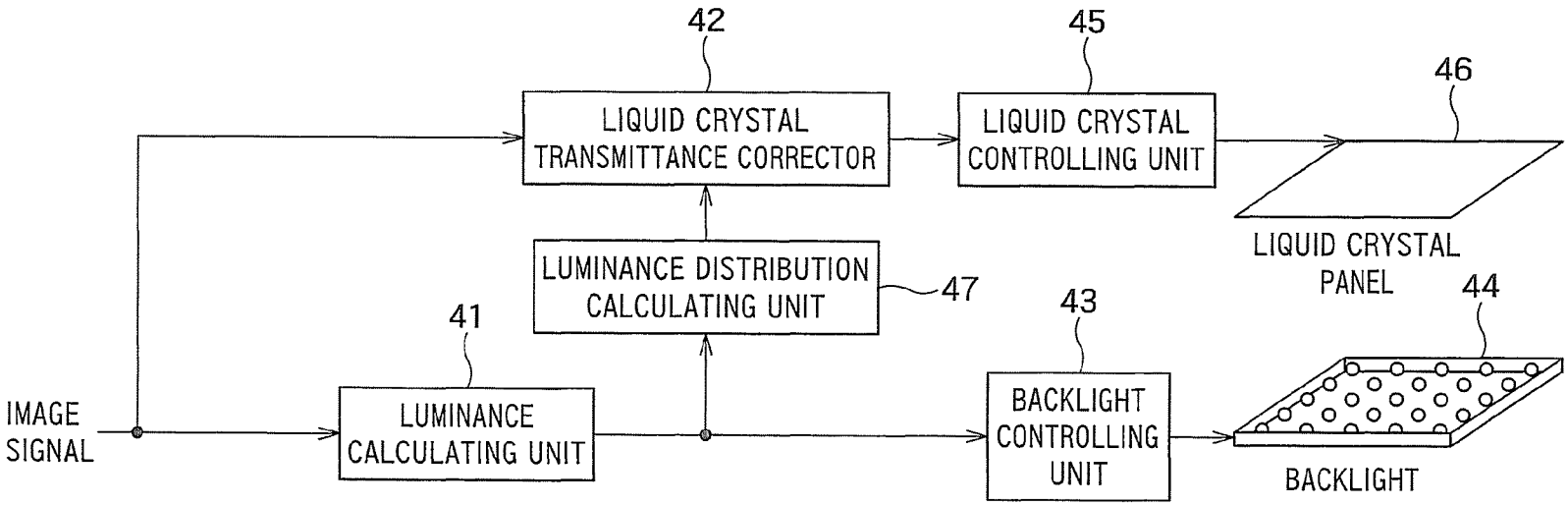
FIG. 14 is a view showing a constitution example of an image display apparatus according to a second embodiment.

FIG. 14 shows a configuration of the image display apparatus according to the present embodiment. The image display apparatus according to the second embodiment is vastly different from the image display apparatus according to the first embodiment in that the light-emission intensity and the light-emission timing of each of a plurality of light sources constituting a backlight 44 are individually controllable by a backlight controlling unit 43. Further, the image display apparatus according to the present embodiment desirably has a luminance distribution calculating unit 47, and in the present embodiment, it is assumed that the apparatus has the luminance distribution calculating unit 47.

In the following, the configuration and operation of each unit are described in detail.

Backlight 44

The backlight 44 has a plurality of light sources. These light sources are individually lighted strongly or weakly by control of the backlight controlling unit 43, and irradiate the liquid crystal panel 46 from the back surface thereof.

Figure 15:
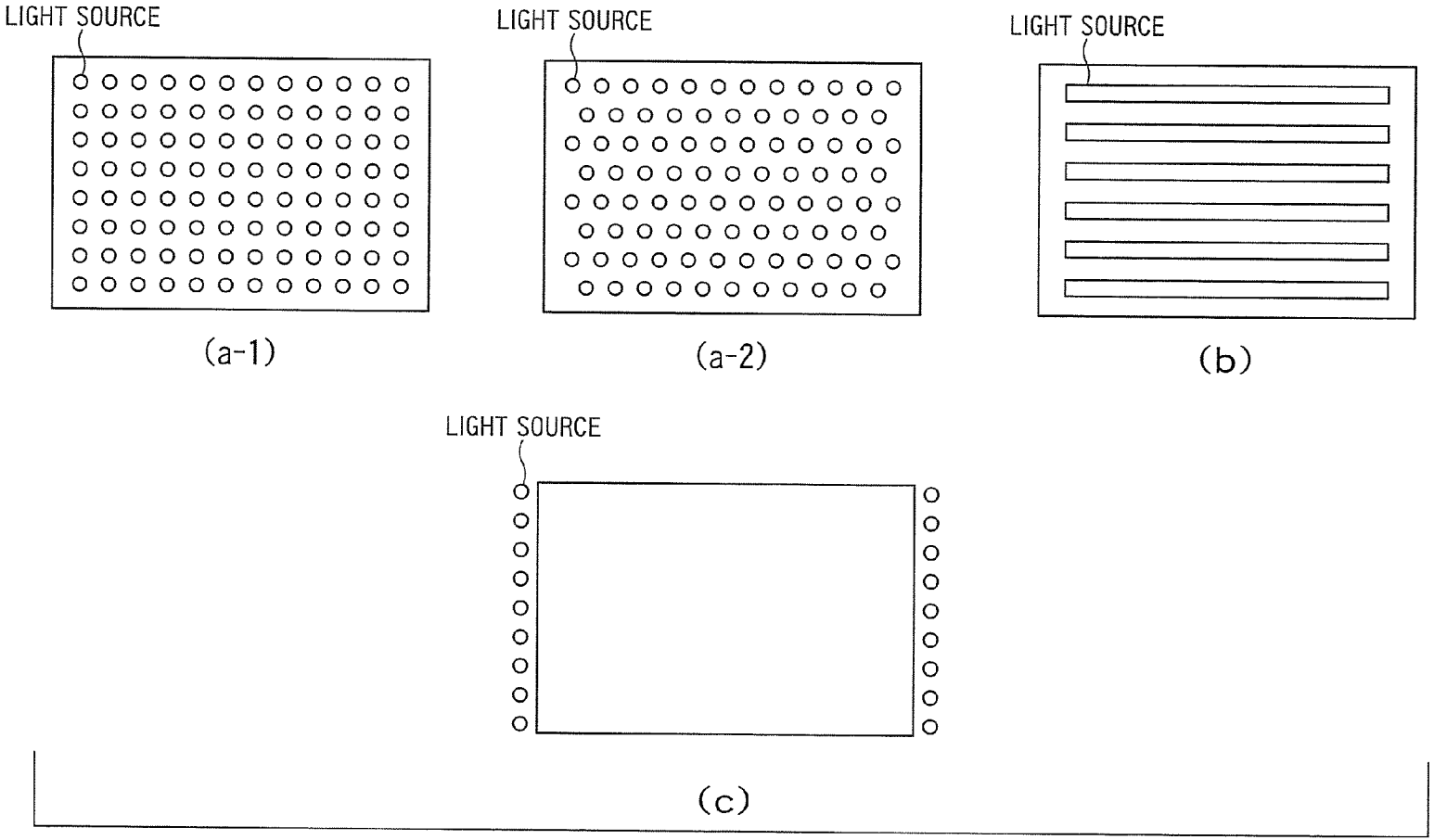
FIG. 15 is a view showing a constitution example of a backlight according to the second embodiment.

FIGS. 15(*a*-1), (*a*-2), (*b*), and (*c*) show a configuration of one specific example of this backlight 44. As shown in FIGS. 15(*a*-1), (*a*-2), (*b*), and (*c*), the backlight 44 has at least not less than one light sources. The arrangement of the light sources may be a direct type as shown in FIGS. 15(*a*-1), (*a*-2), (*b*), where the light sources are arranged on the back surface of the liquid crystal panel 46, or may be an edge light type as shown in FIG. 15(*c*), where the light sources are arranged on the side surfaces of the liquid crystal panel 46 and light is led to the back surface of the liquid crystal panel 46 by a light guiding board or a reflector, not shown, to irradiate the liquid crystal panel 46 from the back surface thereof.

Figure 16B:
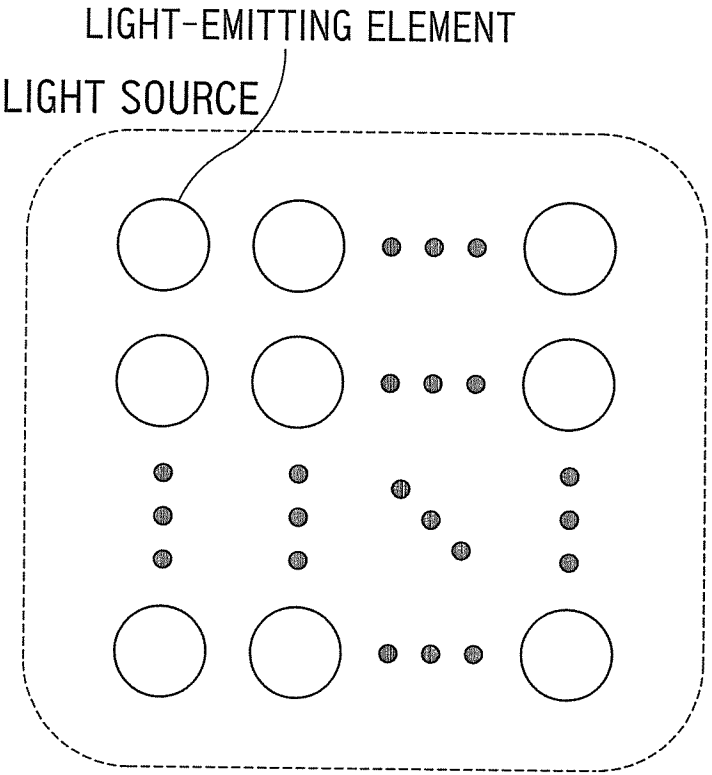
FIGS. 16A and 16B are views showing a constitution example of a light source.
Figure 16A:
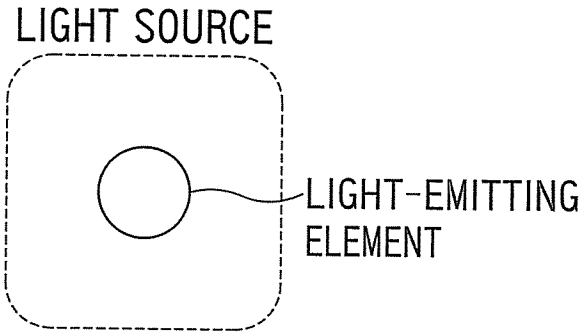

Although each light source is shown in FIG. 15 as if it is configured of a single light-emitting element, the light source may be configured of a single light-emitting element as in FIG. 16A, or may be configured such that a plurality of light-emitting elements are arranged along a surface which is parallel or vertical to the liquid crystal panel 46 as in FIG. 16B.

An LED, a cold-cathode tube, a hot-cathode tube, and the like are suitable for the light-emitting element. The LED is particularly preferably used as the light-emitting element since the LED has a large width between the maximum light emittable luminance and the minimum light emittable luminance and hence its light emission can be controlled in a high dynamic range. The light-emission intensity (light-emission luminance) and the light-emission timing of the light source are controllable by the backlight controlling unit 43.

Backlight Controlling Unit 43

The backlight controlling unit 43 makes each light source, constituting the backlight 44, lighted strongly or weakly based upon the luminance modulation ratio of each light source calculated by a luminance calculating unit 41. The backlight controlling unit 43 is capable of independently controlling the light-emission intensity (light-emission luminance) and the light-emission timing of each light source constituting the backlight 44.

Luminance Calculating Unit 41

Figure 17:
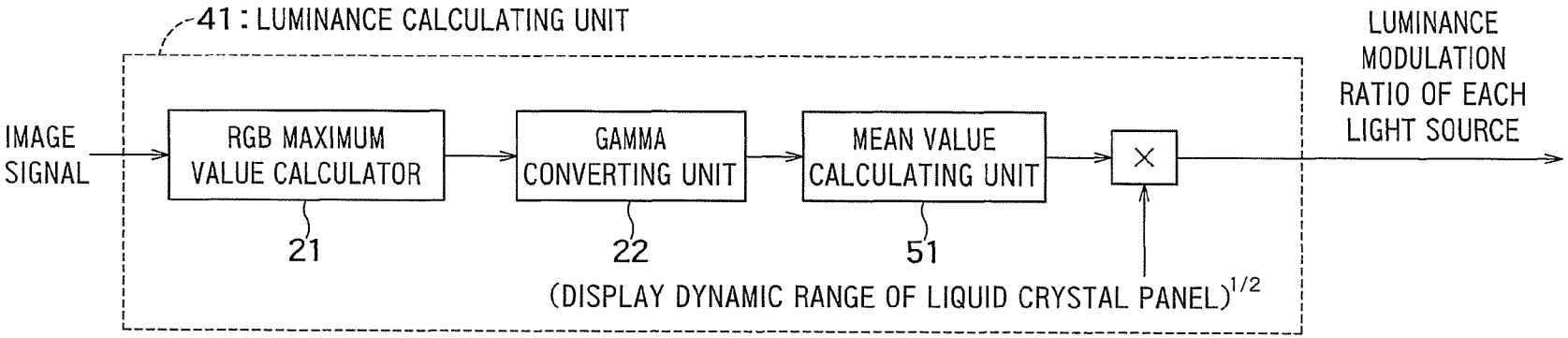
FIG. 17 is a view showing a constitution example of a luminance calculating unit according to the second embodiment.

FIG. 17 shows a constitution example of the luminance calculating unit 41 according to the second embodiment. The luminance calculating unit 41 calculates, from an image signal, a luminance modulation ratio of each light source which is suitable for a display. The luminance calculating unit 41 according to the second embodiment is vastly different from the luminance calculating unit 11 according to the first embodiment in the configuration of a mean value calculating unit 51.

The mean value calculating unit 51 of the luminance calculating unit 41 according to the second embodiment calculates, with respect to each light source constituting the backlight 44, a mean value of the RGB maximum luminance from the RGB maximum luminances of a plurality of pixels within a spatial range corresponding to an irradiation range of each light source on the liquid crystal panel 46. The spatial range as an object for calculating the mean value with respect to each light source may be a spatial range substantially agrees with the irradiation range of each light source, or may be a larger or smaller spatial range than this.

The luminance calculating unit 41 according to the second embodiment outputs a value, obtained by multiplying a mean relative luminance with respect to each light source which was calculated in the average value calculating unit 51 by a square root of a display dynamic range of the liquid crystal panel 46, as a luminance modulation ratio of each light source.

Or, the luminance calculating unit 41 may be modified in manners as described below.

Figure 18:
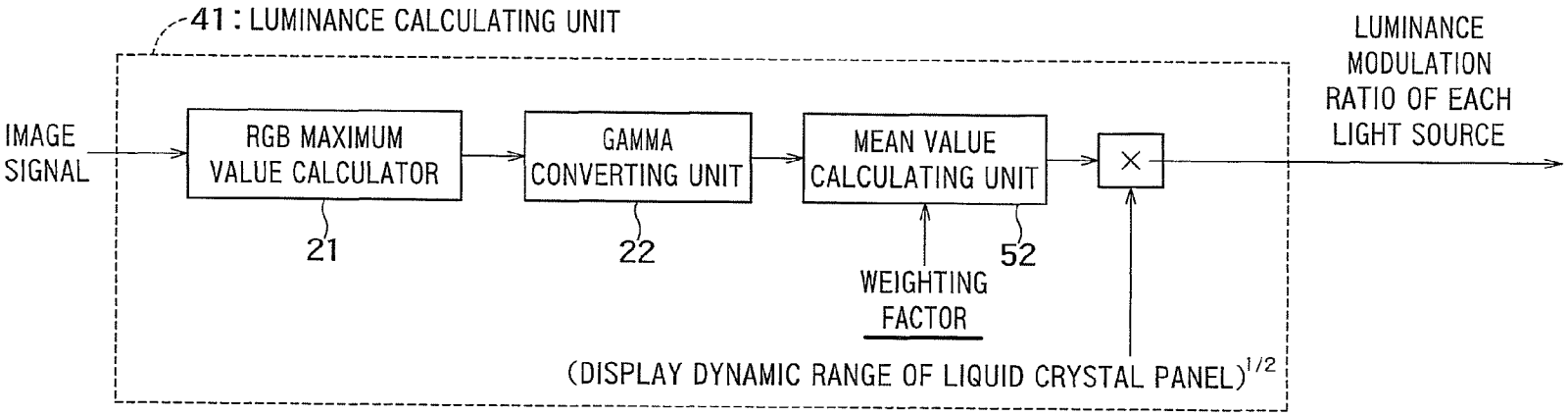
FIG. 18 is a view showing another constitution example of the luminance calculating unit according to the second embodiment.

Modified Example 1 of Luminance Calculating Unit 41 According to Second Embodiment As shown in FIG. 18, the luminance calculating unit 41 of the present embodiment may be configured to reference a weighting factor previously set in the mean value calculating unit 52 and calculates a weighted mean within the spatial range corresponding to the irradiation range on the liquid crystal panel 46 of the light source.

Figure 19:
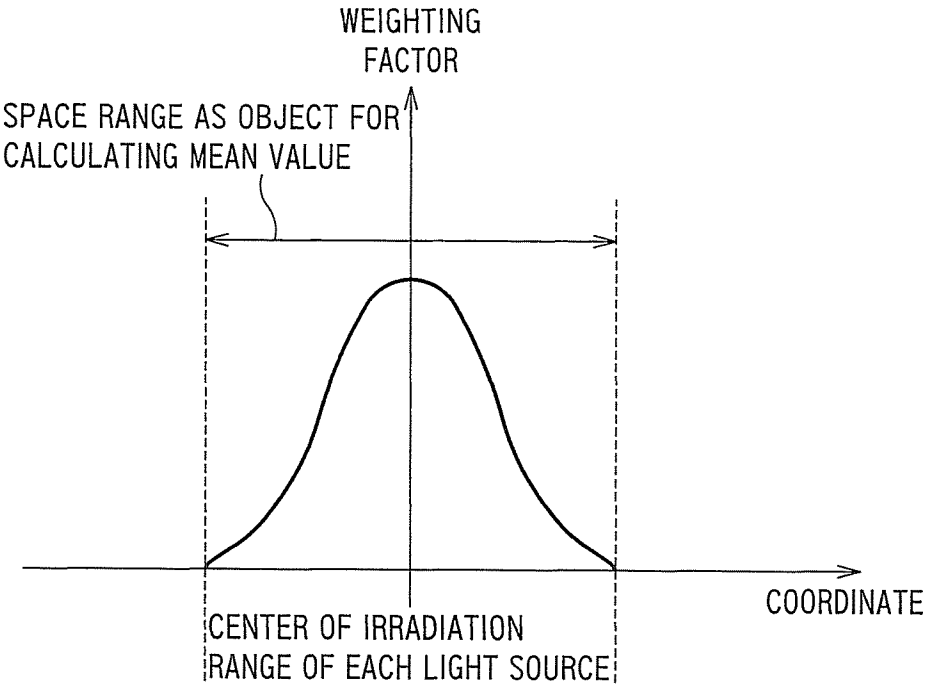
FIG. 19 is a view explaining a weighed coefficient.

A mean value calculating unit 52 of the present modified example calculates a weighted mean of the RGB maximum luminance from RGB maximum luminances of a plurality of pixels. The weighting factor may be a factor, for example as shown in FIG. 19, with which a weight is defined with respect to a spatial coordinate in the irradiation range of each light source. As the weighting factor, a weighting factor periodically having a low-pass characteristic, such as a Gaussian filter, can be used. In the mean value calculating unit 52 of the present modified example, the spatial range as an object for calculating a weighted mean may be a range of the whole liquid crystal panel 46 or a range smaller than this.

There is an advantage in calculating the weighted mean by use of the weighting factor periodically having a low-pass characteristic such that, when a shade shifts on an image signal between irradiation ranges of adjacent light sources, it is possible to make a change in lighting pattern of the backlight 44 smoothly follow up the shift of the shade.

Modified Example 2 of Luminance Calculating Unit 41

Figure 20A:
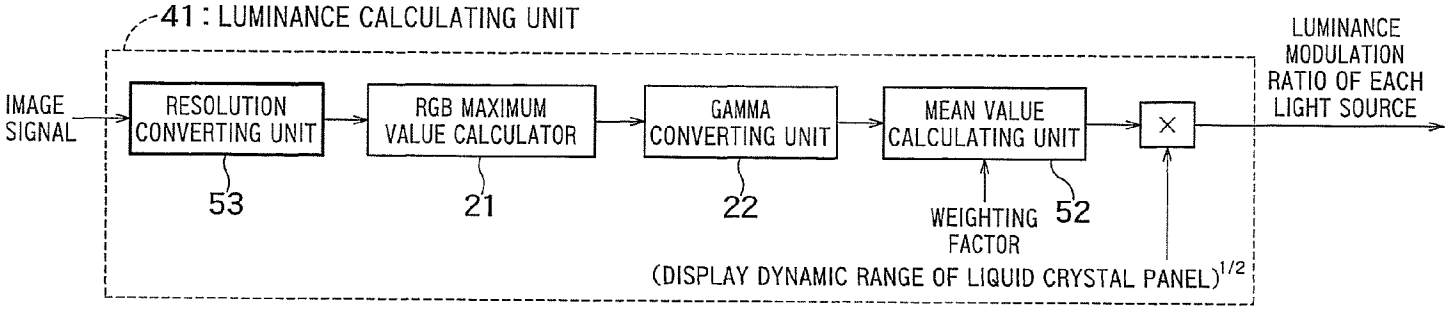
FIGS. 20A, 20B and 20C are views showing still another constitution example of the luminance calculating unit according to the second embodiment.
Figure 20B:
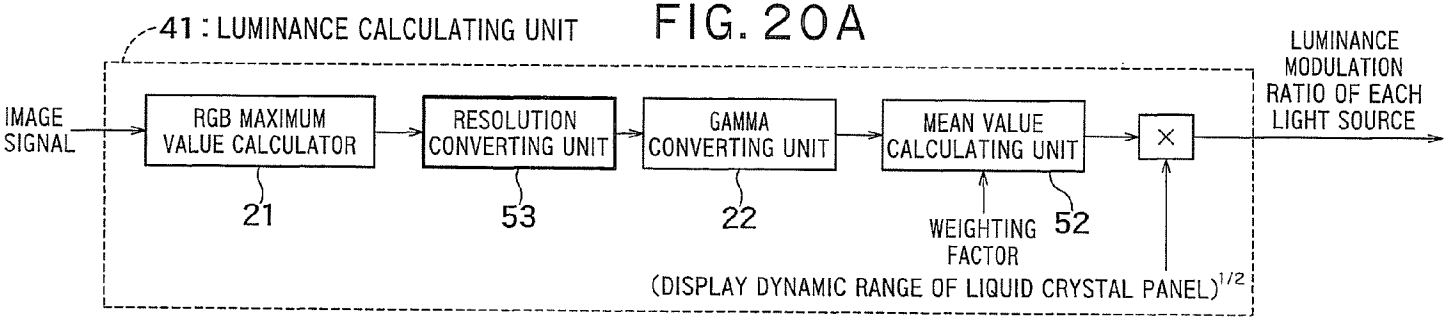
Figure 20C:
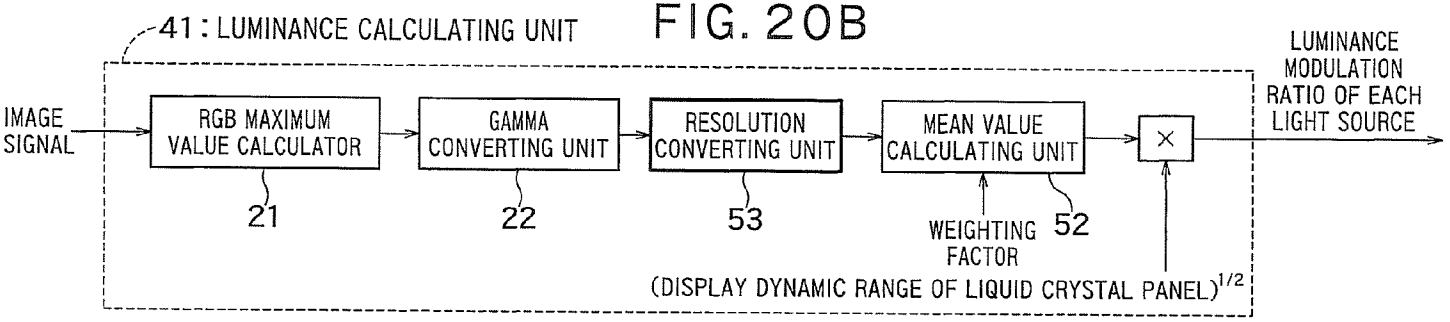

Or, as shown in FIGS. 20A, 20B and 20C, the luminance calculating unit 41 may be configured to apply resolution conversion to an image signal, an RGB maximum signal calculated in the RGB maximum value calculator 21, or an RGB maximum luminance calculated in the gamma converting unit 22, before the calculation of a weighted mean within a spatial region corresponding to an irradiation range of each light source in the mean value calculating unit 52.

The resolution converting unit 53 in the luminance calculating unit 41 of the present modified example converts an image signal, an RGB maximum signal or an RGB maximum luminance into a signal with a rougher space resolution than that of the image signal inputted into the image display apparatus. As a resolution converting technique of the resolution converting unit 53 in the luminance calculating unit 41 of the present modified example, there can be used a known resolution converting technique besides a technique for simply sparsely sampling input signals and a technique for applying a low-pass filter to input signals and then sparsely sampling the input signals.

With the luminance calculating unit 41 configured in this manner, it is possible to improve the follow-up characteristic of the lightening pattern of the backlight 44 at the time of shift of a shade on an image signal between irradiation ranges of adjacent light sources with a smaller computing amount than that in Modified Example 1 of the luminance calculating unit 41 according to the second embodiment.

Modified Example 3 of Luminance Calculating Unit 41

Figure 21A:
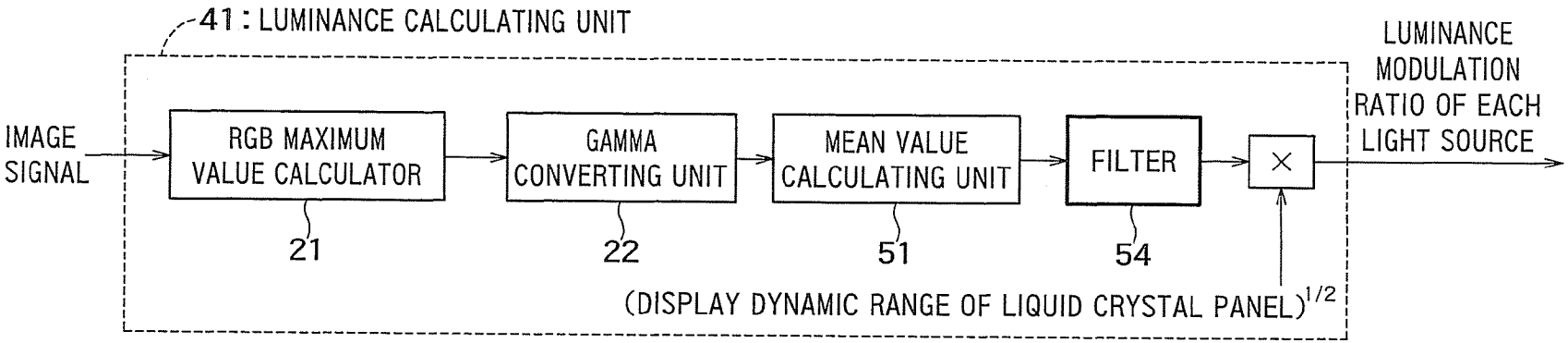
FIGS. 21A and 21B are views showing still another constitution example of the luminance calculating unit according to the second embodiment.
Figure 21B:
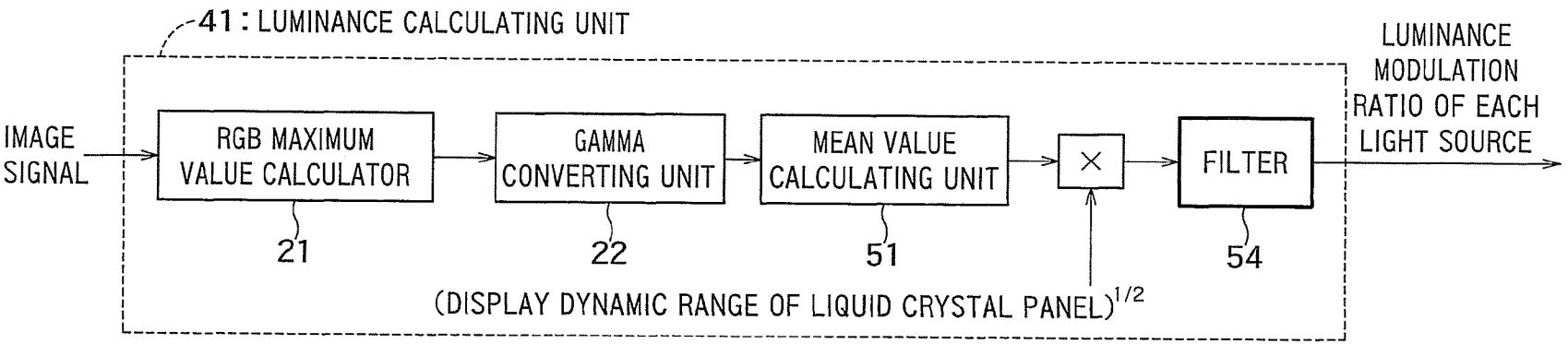

Or, as shown in FIGS. 21A and 21B, the luminance calculating unit 41 may be configured to calculate a mean value within a spatial region corresponding to an irradiation range on the liquid crystal panel 46 with respect to each light source in the average value calculating unit 51, and thereafter apply filtering to the calculated mean value or the luminance modulation ratio.

A filter 54 in the luminance calculating unit 41 of the present modified example applies filtering in the spatial direction to the mean value or the luminance modulation ratio corresponding to each light source based upon the relation among the irradiation position of each light source. As the filter 54 in the luminance calculating unit 41 of the present modified example, a filter having a low-pass characteristic in terms of a spatial frequency, such as the Gaussian filter, can be used.

With the luminance calculating unit 41 configured in this manner, it is possible to improve in some degree the follow-up characteristic of the lightening pattern of the backlight 44 at the time of shift of a shade on an image signal between irradiation ranges of adjacent light sources with a smaller computing amount than that in Modified Example 1 of the luminance calculating unit 41 according to the second embodiment.

Luminance Distribution Calculating Unit 47

The luminance distribution calculating unit 47 according to the second embodiment calculates, from a luminance modulation ratio of each light source which was calculated by the luminance calculating unit 41, an expected value of the luminance distribution of light that is actually incident on the liquid crystal panel 46 from the backlight 44 at the time of lighting of the backlight 44 with the luminance modulation ratio.

Figure 22:
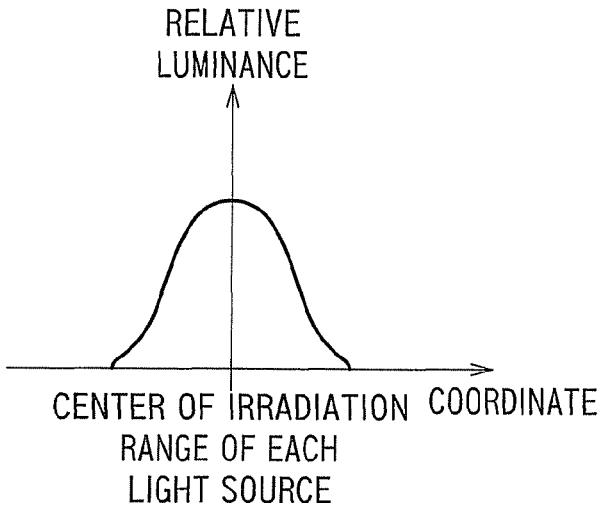
FIG. 22 is a view showing an example of a luminance distribution of the light source.

Since each light source of the backlight 44 has a light-emission distribution in accordance with an actual hardware configuration, the intensity of light incident on the liquid crystal panel 46 by lightening of the light source also has a distribution in accordance with the actual hardware configuration. Here, the intensity of the light incident on the liquid crystal panel 46 is expressed simply as the luminance of the backlight 44 or the light source. FIG. 22 shows an example of the luminance distribution of the light source. This luminance distribution is a distribution symmetrical to the center of the irradiation range of each light source, with the relative luminance decreasing as drawing away from the center of the irradiation range of the light source. The relative luminance at each coordinate at the time of lightening of the n-th light source "n" with a luminance modulation ratio "$L_{set,n}$", can be expressed using this luminance distribution:

$$L_{BL}(x'_n, y'_n) = L_{set,n} \cdot L_{p,n}(x'_n, y'_n) \quad \text{[Formula 5]}$$

In Formula (5), $(x'_n, y'_n)$ is a relative coordinate of a point from the center of the irradiation range of the light source "n", and "$L_{p,n}$" is a luminance distribution of the light source "n" at that point.

The luminance distribution of the backlight 44 at the time of lighting of each light source of the backlight 44 with the luminance modulation ratio "$L_{set,n}$" is calculated as a sum of values each obtained by multiplying the luminance distribution of each light source by the luminance modulation ratio of each light source.

Figure 23:
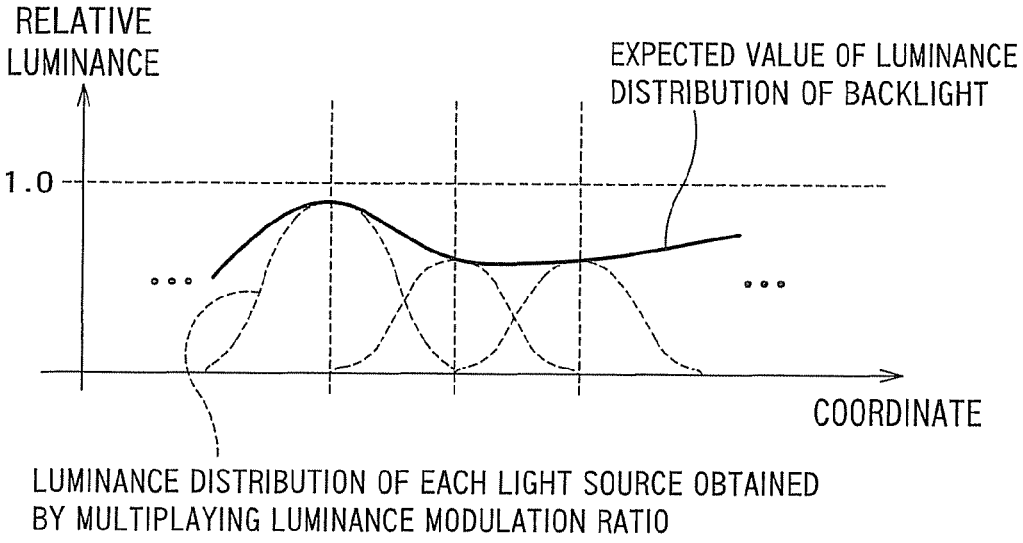
FIG. 23 is a view schematically showing a method for calculating an expected value of a luminance distribution of the backlight.

FIG. 23 schematically shows a method for calculating an expected value of the luminance distribution of the backlight 44. Namely, the luminance distribution of the backlight 44 is calculated by Formula (6) below by use of the luminance distribution "$L_{p,n}$".

$$L_{BL}(x, y) = \sum_{n=1}^{N} \{L_{set,n} \cdot L_{p,n}(x - x_{0,n}, y - y_{0,n})\} \quad \text{[Formula 6]}$$

In Formula (6), (x, y) is a coordinate of a pixel on the liquid crystal panel 46, and $(x_{0,n}, y_{0,n})$ is a coordinate of the center of the irradiation range of the light source "n" on the liquid crystal panel 46. Symbol "N" denotes a total number of light sources. In Formula (6), although it is defined that the luminance modulation ratio and the luminance distribution of every light source is used in obtaining the luminance in a certain pixel, a luminance modulation ratio and a luminance distribution of a light source which have a small influence on the luminance of that pixel can be omitted in calculation of the luminance.

The luminance distribution of each light source which is used in calculation of the luminance distribution of the backlight 44 may be directly calculated by approximating this with an appropriate function, or may be calculated using a previously prepared lookup table.

Liquid Crystal Transmittance Corrector 42

Figure 24:
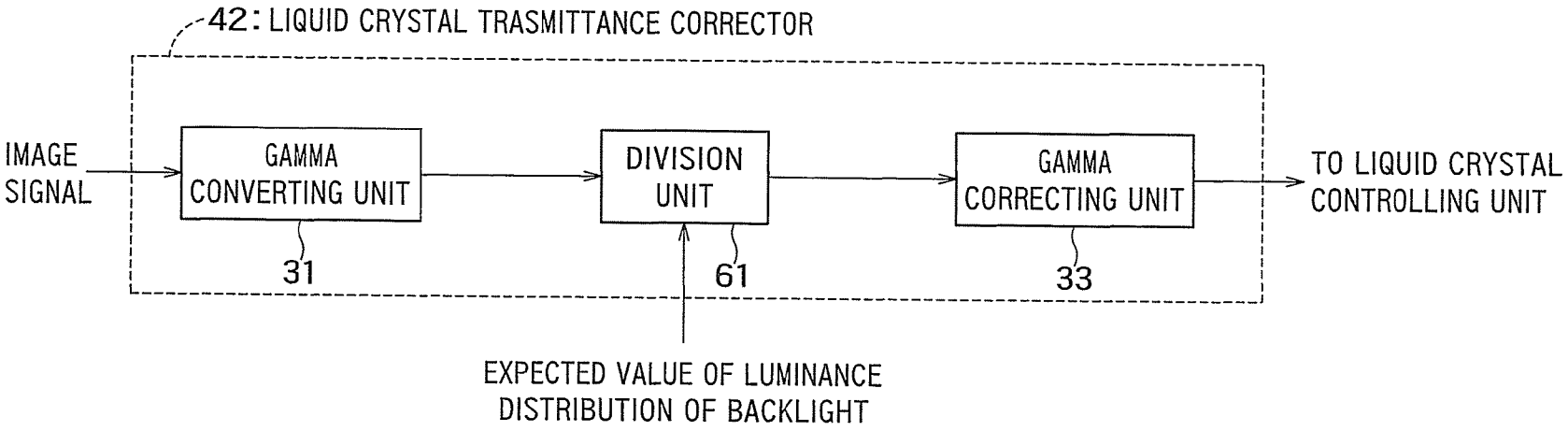
FIG. 24 is a view showing a constitution example of a liquid crystal transmittance corrector according to the second embodiment.

The liquid crystal transmittance corrector 42 corrects a transmittance of an image signal in each pixel of the liquid crystal panel 46 based upon the inputted image signal and the expected value of the luminance distribution of the backlight which was calculated in the luminance distribution calculating unit 47, and outputs the image signal with the corrected transmittance to a liquid crystal controlling unit 45. FIG. 24 shows a configuration of one specific example of this liquid crystal transmittance corrector 42.

This liquid crystal transmittance corrector 42 includes the gamma converting unit 31, a division unit 61 and the gamma correcting unit 33.

The liquid crystal transmittance corrector 42 according to the second embodiment is vastly different from the liquid crystal transmittance corrector 12 according to the first embodiment in that the division unit 61 calculates a corrected light transmittance from corrected light transmittances of R, G, B of each pixel which were calculated in the gamma converting unit 31 and the expected value of the luminance distribution of the backlight 44 which was calculated in the luminance distribution calculating unit 47.

The division unit 61 according to the second embodiment calculates a corrected light transmittance from the corrected light transmittances of R, G, B of each pixel which were calculated in the gamma converting unit 31 and the expected value of the luminance distribution of the backlight 44 which was calculated in the luminance distribution calculating unit 47. Computing in the division unit 61 may be computing by a divider configured so as to divide the light transmittances of R, G, B of each pixel which were calculated in the gamma converting unit 31 by the expected value of the luminance distribution of the backlight which was calculated in the luminance distribution calculating unit 47, or may be modified to computing in which a lookup table that previously holds relations of values corresponding to input and output are held and a corrected light transmittance is calculated with reference to this lookup table.

Liquid Crystal Panel 46 and Liquid Crystal Controlling Unit 45

The liquid crystal panel 46 and the liquid crystal controlling unit 45 according to the second embodiment may be the same as the liquid crystal panel 16 and the liquid crystal controlling unit 15 according to the first embodiment.

Effects of the Present Embodiment

According to the image display apparatus of the present embodiment, it is possible to alleviate fluctuations in luminance due to a mean effect and thus suppress flickering, and also to make an image display with a wider dynamic range and lower consumption power than those of the image display apparatus according to the first embodiment.

The invention claimed is:

1. An image display apparatus for displaying images based on an input image, comprising:

a backlight configured to emit light;

a liquid crystal panel configured to modulate light emitted from said backlight to make an image display;

a backlight luminance calculating unit configured to calculate a light-emission luminance of said backlight such that a center value of a luminance range displayable on said liquid crystal panel defined depending on the light-emission luminance of said backlight substantially agrees with a center value of luminances of each pixel forming the input image;

a backlight controlling unit configured to control light emission of said backlight so that the light is emitted with the calculated light-emission luminance;

a luminance correcting unit configured to correct the luminances of each pixel in the input image in accordance with said calculated light-emission luminance; and a liquid crystal controlling unit configured to control modulation of said liquid crystal panel based upon the corrected input image, wherein said backlight luminance calculating unit multiplies a center value of the luminances of said each pixel by a square root of a display dynamic range of said liquid crystal panel to obtain the light-emission luminance of said backlight.

2. The apparatus according to claim 1, wherein the center value of the luminances of said each pixel is a mean value of the luminances of said each pixel.

3. The apparatus according to claim 1, wherein the center value of the luminances of said each pixel is a Median Value of the luminances of said each pixel.

4. The apparatus according to 1, wherein the center value of the luminances of said each pixel is a mode value of the luminances of said each pixel.

5. The apparatus according to claim 1, wherein said luminance correcting unit divides the luminances of said each pixel by said calculated light-emission luminance to correct the luminances of said each pixel.

6. The apparatus according to claim 1, wherein said backlight includes a plurality of light sources whose each light-emission luminance are individually controllable; and said backlight luminance calculating unit calculates the light-emission luminance of each of said light sources by use of pixels within a spatial range depending on an irradiation range of each of said light sources to said liquid crystal panel.

7. The apparatus according to claim 6, wherein said backlight luminance calculating unit stores weighed coefficients in accordance with each relative position of the pixels within the spatial region of each of the light sources, and calculates a weighted mean of the luminances of pixels within the spatial region of each of the light sources, respectively, and multiplies the calculated weighted mean by a square root of a display dynamic range of said liquid crystal panel to obtain the light-emission luminance of each of the light sources, respectively.

8. An image display method performed using a backlight configured to emit light and a liquid crystal panel configured to modulate light emitted from said backlight to make an image display, comprising:

calculating a light-emission luminance of said backlight such that a center value of a luminance range displayable on said liquid crystal panel defined depending on the light-emission luminance of said backlight substantially agrees with a center value of luminance of each pixel forming an input image;

controlling light emission of said backlight so that the light is emitted with the calculated light-emission luminance;

correcting the luminance of each pixel in the input image in accordance with said calculated light-emission luminance; and controlling modulation of said liquid crystal panel based upon the corrected input image, wherein said calculating a light-emission luminance of said backlight includes multiplying a center value of the luminances of said each pixel by a square root of a display dynamic range of said liquid crystal panel to obtain the light-emission luminance of said backlight.

* * * * *